US007669848B2

(12) United States Patent
Watanabe

(10) Patent No.: US 7,669,848 B2
(45) Date of Patent: Mar. 2, 2010

(54) CONVEYING APPARATUS AND IMAGE FORMING APPARATUS

(75) Inventor: Yusaku Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 388 days.

(21) Appl. No.: 11/614,752

(22) Filed: Dec. 21, 2006

(65) Prior Publication Data

US 2007/0152398 A1 Jul. 5, 2007

(30) Foreign Application Priority Data

Dec. 29, 2005 (JP) ..... 2005-380595

(51) Int. Cl.
*B65H 5/00* (2006.01)

(52) U.S. Cl. ..... 271/264

(58) Field of Classification Search ..... 271/264
See application file for complete search history.

(56) References Cited

U.S. PATENT DOCUMENTS 5,127,642 A * 7/1992 Takimoto et al. ..... 271/3.19
5,702,191 A 12/1997 Kakizaki et al.
6,065,886 A 5/2000 Embry et al.
2005/0196216 A1 * 9/2005 Tanahashi et al. ..... 400/625

FOREIGN PATENT DOCUMENTS

JP 2002 249248 9/2002
JP 2005 247544 9/2005
JP 2006 8328 1/2006

OTHER PUBLICATIONS

European Patent Office, European Search Report mailed Sep. 17, 2007 for Related Application No. EP 06027097.

* cited by examiner

*Primary Examiner*—Patrick H Mackey
*Assistant Examiner*—Ernesto Suarez
(74) *Attorney, Agent, or Firm*—Baker Botts, LLP

(57) ABSTRACT

A conveying apparatus for conveying a flexible sheet along a sheet-convey path including a curved portion. The conveying apparatus includes an outer guide which defines an outer portion of the curved portion of the sheet-convey path. The outer guide includes at least one curved plate having a first curved guide surface which contacts and guides the flexible sheet; and a guide base including at least one holding portion which holds the at least one curved plate. The at least one curved plate is formed of a synthetic resin assuring that the first curved guide surface thereof has a first frictional resistance lower than a second frictional resistance of a surface of the guide base.

20 Claims, 11 Drawing Sheets

CONVEYING APPARATUS AND IMAGE FORMING APPARATUS

The present application is based on Japanese Patent Application No. 2005-380595 filed on Dec. 29, 2005, the contents of which are incorporated herein by reference.

BACKGROUND OF THE INVENTION

1. Field of the Invention

The present invention relates to a conveying apparatus that conveys a flexible sheet such as a recording sheet through a sheet-convey path including a curved portion defined by opposed guide members, from a sheet-supply portion to a sheet-discharge portion for holding and discharging the sheet conveyed.

2. Discussion of Related Art

There has been known a printer employing a conveying apparatus that conveys a recording sheet through a so-called "U-turn" path. For example, Patent Document 1 (Japanese Patent Application Publication No. 2002-249248) discloses a recording apparatus wherein each of recording sheets stacked in a sheet-supply cassette is conveyed by a reversing roller, first upward and then forward, along a U-turn path defined by a curved guide member, and an ink-jet-type recording head records an image on the each recording sheet.

In addition, Patent Document 2 (Japanese Patent Application Publication No. 2002-247544) discloses a recording apparatus wherein a recording sheet is conveyed from a sheet-supply tray to a U-turn path defined by inner and outer curved guide members, and is discharged to a sheet-discharge tray after an image is recorded on the recording sheet by an ink-jet-type recording head.

When the recording sheet is conveyed along the U-turn path, the sheet is guided by the curved guide member(s) while being curved or flexed. More specifically described, the recording sheet is conveyed while being slid on the outer guide member or portion. Therefore, a friction is produced between the recording sheet and the outer guide member or portion. In particular, in the case where a thick recording sheet such as a postcard, or a sheet whose surface is treated with a material giving a high frictional resistance, such as a glossy paper, is conveyed, an increased friction is produced between the recording sheet and the outer guide member. Consequently the speed of conveying of the recording sheet may be made unstable, or even zeroed because the frictional force overcomes the conveying force.

SUMMARY OF THE INVENTION

In the above-identified background, the present invention has been developed. It is therefore an object of the present invention to solve at least one of the above-identified problems. It is another object of the present invention to provide the art of reliably lowering a friction produced between a flexible sheet and a guide member when the sheet is conveyed in a sheet-convey path including a curved portion.

According to a first aspect of the present invention, there is provided a conveying apparatus for conveying a flexible sheet along a sheet-convey path including a curved portion. The conveying apparatus comprises an outer guide which defines an outer portion of the curved portion of the sheet-convey path. The outer guide includes at least one curved plate having a first curved guide surface which contacts and guides the flexible sheet; and a guide base including at least one holding portion which holds the at least one curved plate. The at least one curved plate is formed of a synthetic resin assuring that the first curved guide surface thereof has a first frictional resistance lower than a second frictional resistance of a surface of the guide base.

In the present conveying apparatus, the flexible sheet is conveyed through the sheet-convey path. The sheet-convey path includes the curved portion, and the conveying apparatus comprises the outer guide defining the outer portion of the curved portion of the sheet-convey path. The outer guide includes the at least one curved plate having the first curved guide surface which contacts and guides the flexible sheet. The flexible sheet is conveyed by being guided by the first curved guide surface, while the sheet is deformed or flexed. The outer guide additionally includes the guide base including the at least one holding portion that holds the at least one curved plate. The at least one curved plate is formed of the synthetic resin assuring that the first curved guide surface thereof has the first frictional resistance lower than the second frictional resistance of the surface of the guide base. Since the first curved guide surface has the low functional resistance, the flexible sheet can be conveyed smoothly. In addition, the guide base may be formed of a material that is advantageous with respect to formability and/or appearance than with respect to frictional resistance. Therefore, the outer guide can enjoy a low frictional resistance and a good external appearance.

According to a second aspect of the present invention, there is provided an image forming apparatus, comprising the conveying apparatus according to the first aspect of the invention; and an image forming portion which is provided in the sheet-convey path and which forms an image on the flexible sheet conveyed along the sheet-convey path by the conveying apparatus.

The present image forming apparatus enjoys the same advantages as those described above with respect to the conveying apparatus in accordance with the first aspect of the invention.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENT

Hereinafter, there will be described preferred embodiments of the present invention by reference to the drawings.

Figure 1:
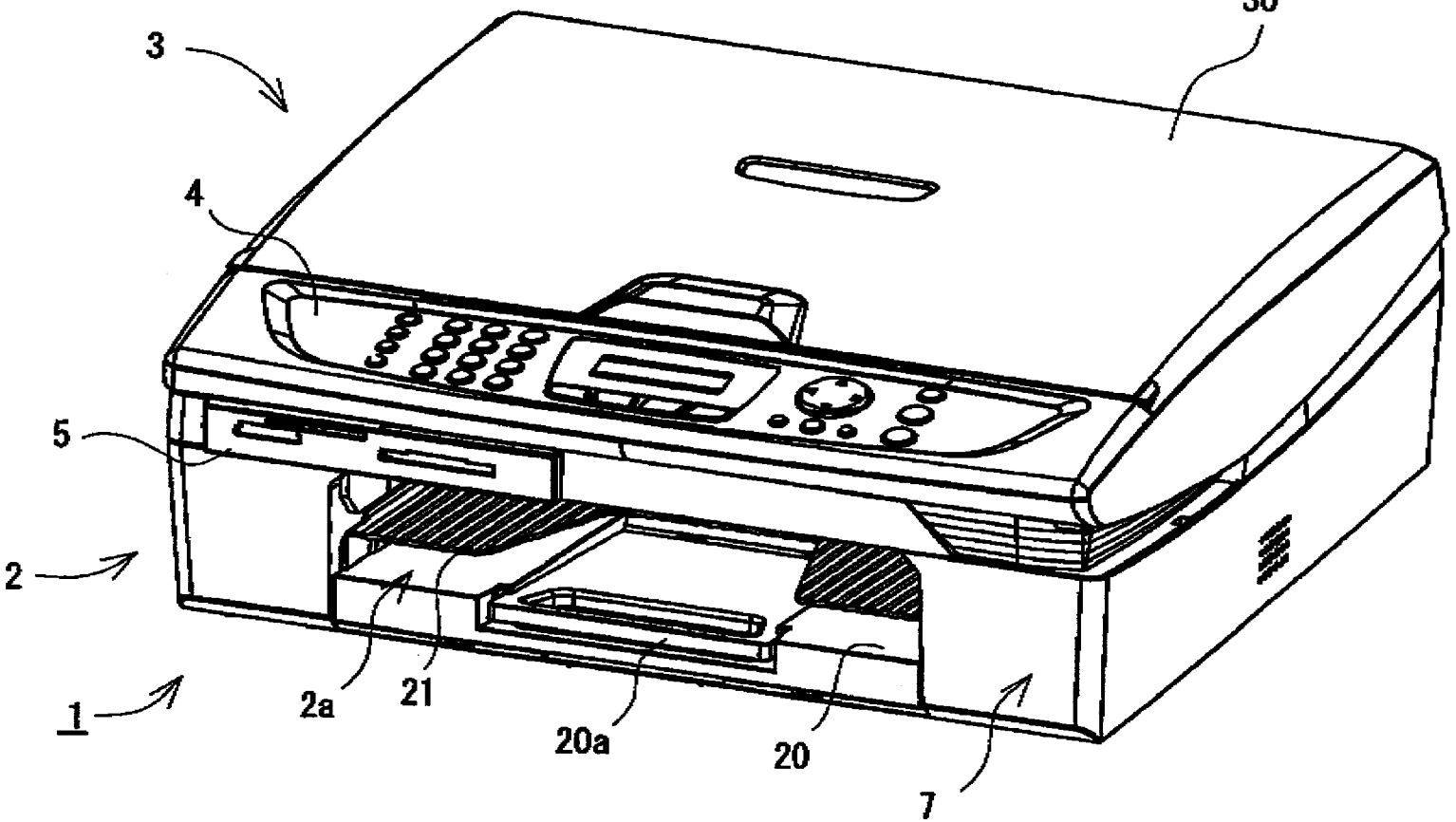
FIG. 1 is a perspective view showing an external construction of a multi-function device (MFD) 1 to which the present invention is applied.
Figure 2:
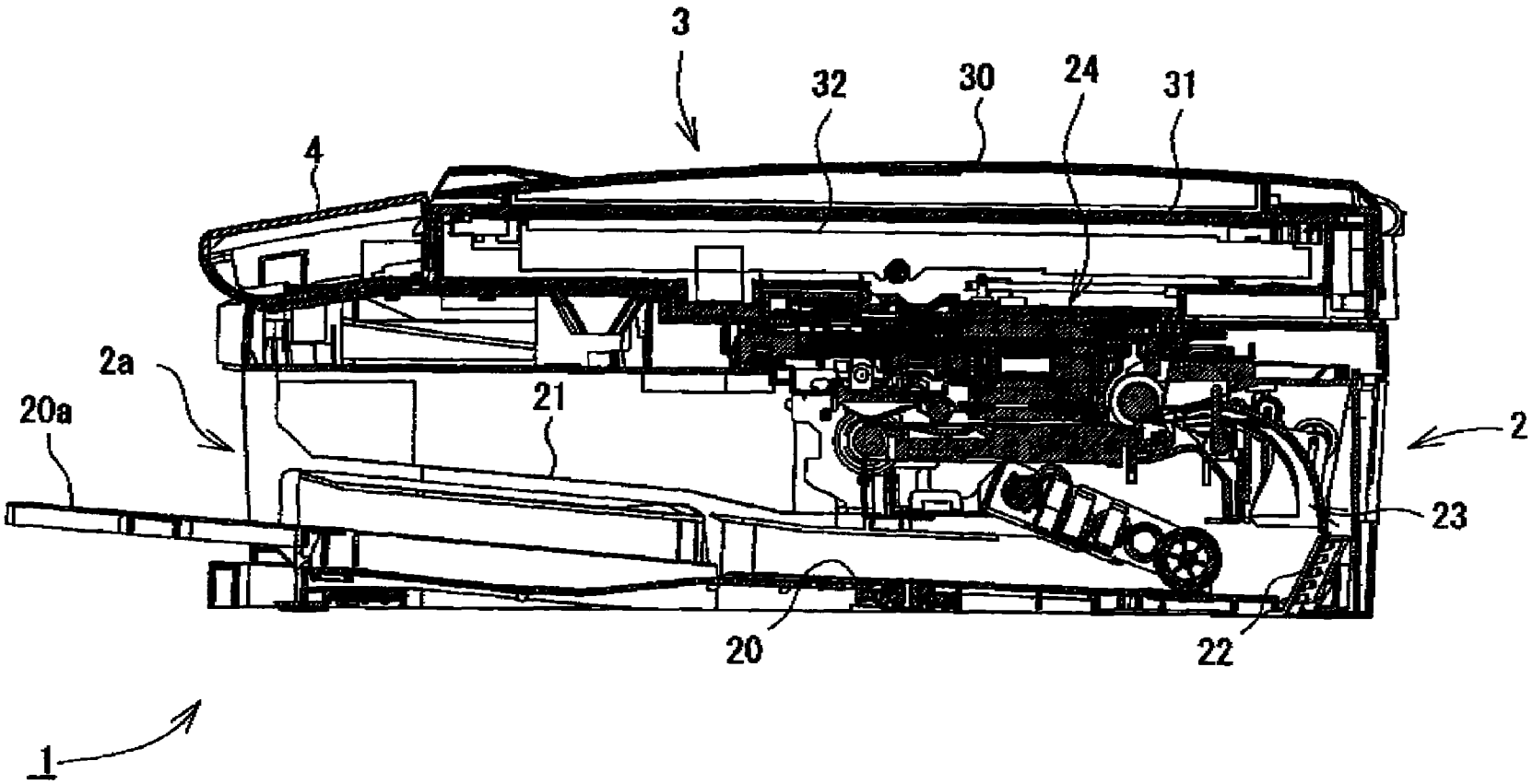
FIG. 2 is a cross-sectional view showing an internal construction of the MFD 1.

FIG. 1 shows an external appearance of a "multi-function device (MFD)" 1; and FIG. 2 shows an internal construction of the MFD 1. The MFD 1 has a printer function, a scanner function, a copier function, and a facsimile-machine function, and includes a printer portion 2 provided in a lower portion thereof, and a scanner portion 3 provided in an upper portion thereof that is integral with the lower portion. In the MFD 1, the printer portion 2 corresponds to an image forming apparatus to which the present invention is applied, and accordingly the functions other than the printer function may be omitted. That is, the present invention may be applied to a single-function printer that has only the printer function and does not have the scanner, copier, or facsimile-machine function. For example, the scanner portion 3 may be omitted from the MFD 1. In addition, the printer portion 2 employs a conveying apparatus to which the present invention is also applied. However, the printer portion 2 is just an example that employs the conveying apparatus of the present invention. That is, the conveying apparatus of the present invention may be applied to other sorts of apparatuses than the printer portion 2 as the image forming apparatus. For example, the scanner portion 3 as an image reading apparatus may employ, as a portion of an automatic document feed (ADF) thereof, the conveying apparatus of the present invention.

As shown in FIG. 1, a length and a width of the MFD 1 are greater than a height thereof. Thus, the MFD 1 has a flat appearance with a generally rectangular parallelepiped shape. In the lower portion of the MFD 1, there is provided the printer portion 2. The printer portion 2 has a front opening 2*a* formed in a front surface of the MFD 1, and additionally has a sheet-supply tray 20 as a sheet-supply portion and a sheet-discharge tray 21 as a sheet-discharge portion both of which are exposed through the front opening 2*a* such that the sheet-discharge tray 21 is provided above the sheet-supply tray 20. The sheet-supply tray 20 is for storing a plurality of recording sheets each as a flexible sheet, and can accommodate sheets of various sizes not larger than A4 Size, such as A4 Size, B5 Size, or Postcard Size. As shown in FIG. 2, the sheet-supply tray 20 includes a slideable member 20*a* that is extensible to increase a bottom-surface area of the tray 20, so that the tray 20 can accommodate Legal-Size recording sheets. As will be described later, the recording sheets stored by the sheet-supply tray 20 are supplied, one by one, to an image recording unit 24 of the printer portion 2, so that a desired image is recorded on each recording sheet and then the each recording sheet is discharged onto the sheet-discharge tray 21. In the present embodiment, the conveying apparatus conveys the recording sheets. However, the conveying apparatus may convey other sorts of flexible sheets, such as a synthetic-resin sheet, that can be conveyed along a curved sheet-convey path. The image recording unit 24 corresponds to an image forming portion of the image forming apparatus.

An operation panel 4 is provided in a front end portion of the upper portion of the MFD 1. The operation panel 4 is for operating the printer portion 2 and the scanner portion 3. The operation panel 4 includes various operation keys and a liquid crystal display (LCD) that are usable by a user to input various commands to operate the MFD 1. In the case where the MFD 1 is connected to an external computer such as a personal computer (PC), the MFD 1 is operated according to commands supplied from the external computer via a printer driver or a scanner driver. The MFD 1 has, in a left, top portion of the front surface thereof (FIG. 1), a slot portion 5 into which each of various sorts of small-size memory cards each as a recording medium can be inserted. When the operation panel 4 is operated by the user in an appropriate manner, the MFD 1 reads image data stored by the memory card inserted in the slot portion 5, and the LCD of the operation panel 4 displays, based on the thus read image data, information related to the image data. Thus, the user can select, by operating the keys of the operation panel 4, one or more desired images from the image data, so that the printer portion 2 may record or print the image(s) on the recording sheet(s).

Figure 3:
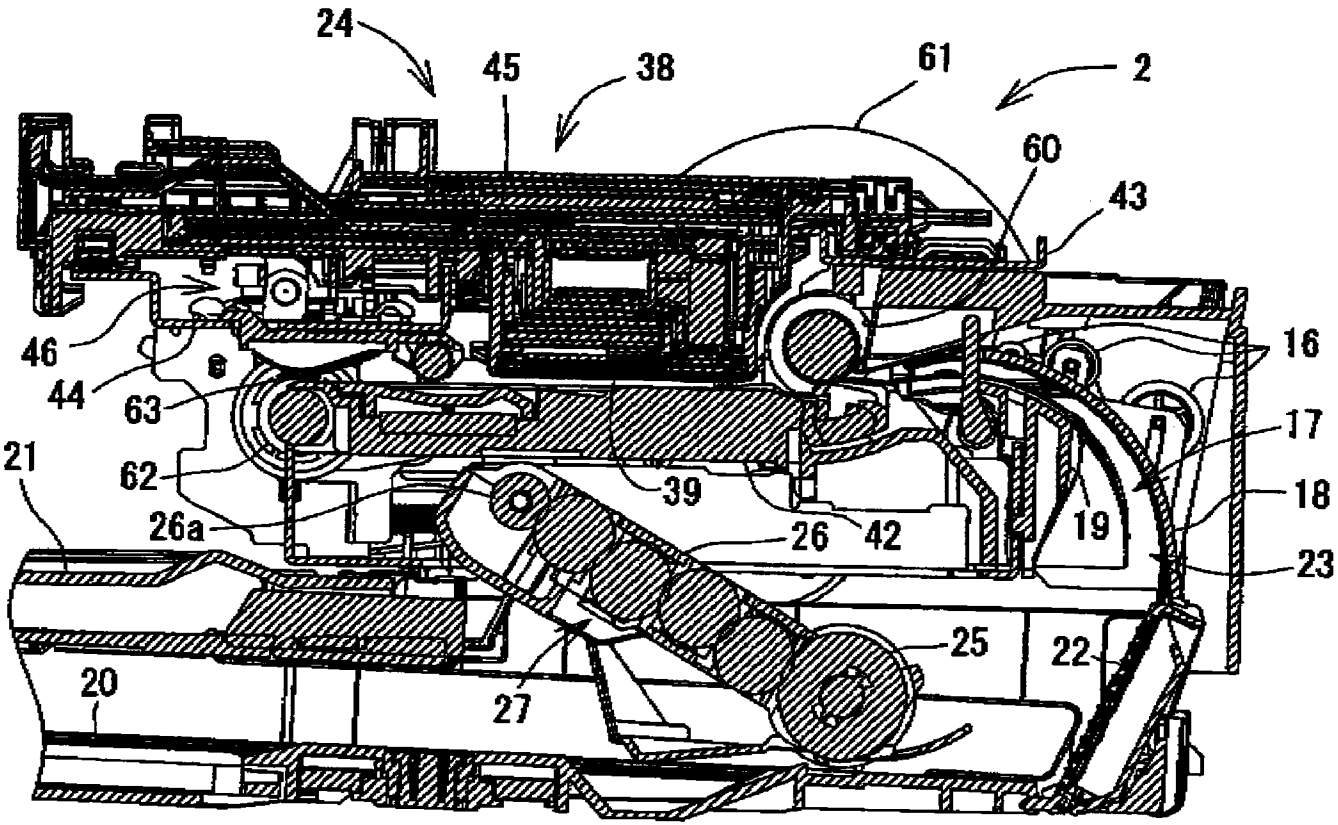
FIG. 3 is an enlarged, cross-sectional view showing a relevant portion of a printer portion 2 of the MFD 1.

Hereinafter, the internal construction of the MFD 1, in particular, the construction of the printer portion 2 will be described by reference to FIGS. 2 through 8. As shown in FIGS. 2 and 3, the sheet-supply tray 20, provided in the bottom portion of the MFD 1, has an inclined sheet-separate plate 22 provided in a downstream-side end portion thereof with respect to a sheet-supply direction in which each recording sheet is supplied from the tray 20. The inclined sheet-separate plate 22 is for separating each of the recording sheets stacked in the sheet-supply tray 20, from the other recording sheets, and guiding a movement of the separated recording sheet in an upward direction toward a sheet-convey path 23. As shown in FIG. 3, the sheet-convey path 23 first extends upward from the sheet-separate plate 22, then curves toward the front side (i.e., left side in the figure) of the MFD 1, and further extends to the front opening 2*a*. That is, the sheet-convey path 23 extends from the rear side of the MFD 1 toward the front side thereof via the image recording unit 24 and the sheet-discharge tray 21. Thus, the sheet-convey path 23 includes a U-turn portion through which the direction of supplying of each recording sheet is reversed from the rearward direction to the frontward direction before the recording sheet is supplied to the image recording unit 24. After the image recording unit 24 records the image on the recording sheet, the each sheet is discharged onto the sheet-discharge tray 21.

As shown in FIG. 3, a sheet-supply roller 25 is provided above the sheet-supply tray 20. The sheet-supply roller 25 cooperates with the inclined sheet-separate plate 22 to separate each of the recording sheets stacked in the sheet-supply tray 20, from the other recording sheets, and supply the thus separated recording sheet to the sheet-convey path 23. The sheet-supply roller 25 is rotatably supported by a lower end portion of a sheet-supply arm 26. In addition, the sheet-supply arm 26 supports a power transmission device 27 that includes a plurality of gears meshed with each other and that is connected, at one end thereof, to the sheet-supply roller 25. When an electric motor (not shown) that is connected to the other end of the power transmission device 27 is driven or rotated, a driving power of the motor is transmitted to the sheet-supply roller 25 via the transmission device 27, so that the roller 25 is rotated to move each recording sheet toward the inclined sheet-separate plate 22. The sheet-supply roller 25, the sheet-supply arm 26, the power transmission device 27, and the electric motor (not shown) cooperate with each other to constitute a portion of a moving device that moves each recording sheet.

An upper or base end portion of the sheet-supply arm 26 is supported by an axis member 26*a*, such that the arm 26 is pivotable downward and upward about the axis member 26*a* so as to be moved toward, and away from, the sheet-supply tray 20. As shown in FIG. 2, a self-weight of the sheet-supply arm 26, and/or a spring, not shown, biase(s) the arm 26 downward toward the sheet-supply tray 20; and when the sheet-supply tray 20 is inserted into, or drawn out of, the MFD 10, the sheet-supply arm 26 is retracted to an upper position thereof. When the sheet-supply arm 26 is pivoted downward, the sheet-supply roller 25 supported by the lower end portion of the arm 26 is pressed on the uppermost one of the recording sheets stacked in the sheet-supply tray 20. If, in this state, the sheet-supply roller 25 is rotated, a frictional force is produced between an outer circumferential surface of the roller 25 and an upper surface of the uppermost recording sheet and, owing to this frictional force, the uppermost sheet is moved toward the inclined sheet-separate plate 22. When the leading end of the uppermost recording sheet engages the inclined sheet-separate plate 22, the recording sheet is guided upward toward the sheet-convey path 23. When the uppermost recording sheet is moved toward the inclined sheet-separate plate 22, the underlying recording sheet or sheets may be moved with the uppermost sheet, because of the friction or static electricity produced therebetween. However, no further movement of the underlying recording sheet or sheets is allowed by the sheet-separate plate 22.

As described above, the sheet-convey path 23 includes the U-turn portion where each recording sheet is reversed while it is conveyed upward from the sheet-supply tray 20 and then horizontally to the sheet-discharge tray 21. The U-turn portion is constituted by a curved portion 17 that is provided in the rear side of the MFD 1 and has a generally arcuate cross section. The curved portion 17 is constituted by an outer guide 18 and an inner guide 19 that are opposed to each other with an appropriate space left therebetween. The outer guide 18 includes guide rollers 16, such that the guide rollers 16 are freely rotatable about respective axis lines each parallel to a widthwise direction of the sheet-convey path 23. Owing to the guide rollers 16, each recording sheet can be conveyed smoothly along the outer guide 18. The outer guide 18 and the guide rollers 16 will be described in detail, later.

Figure 4:
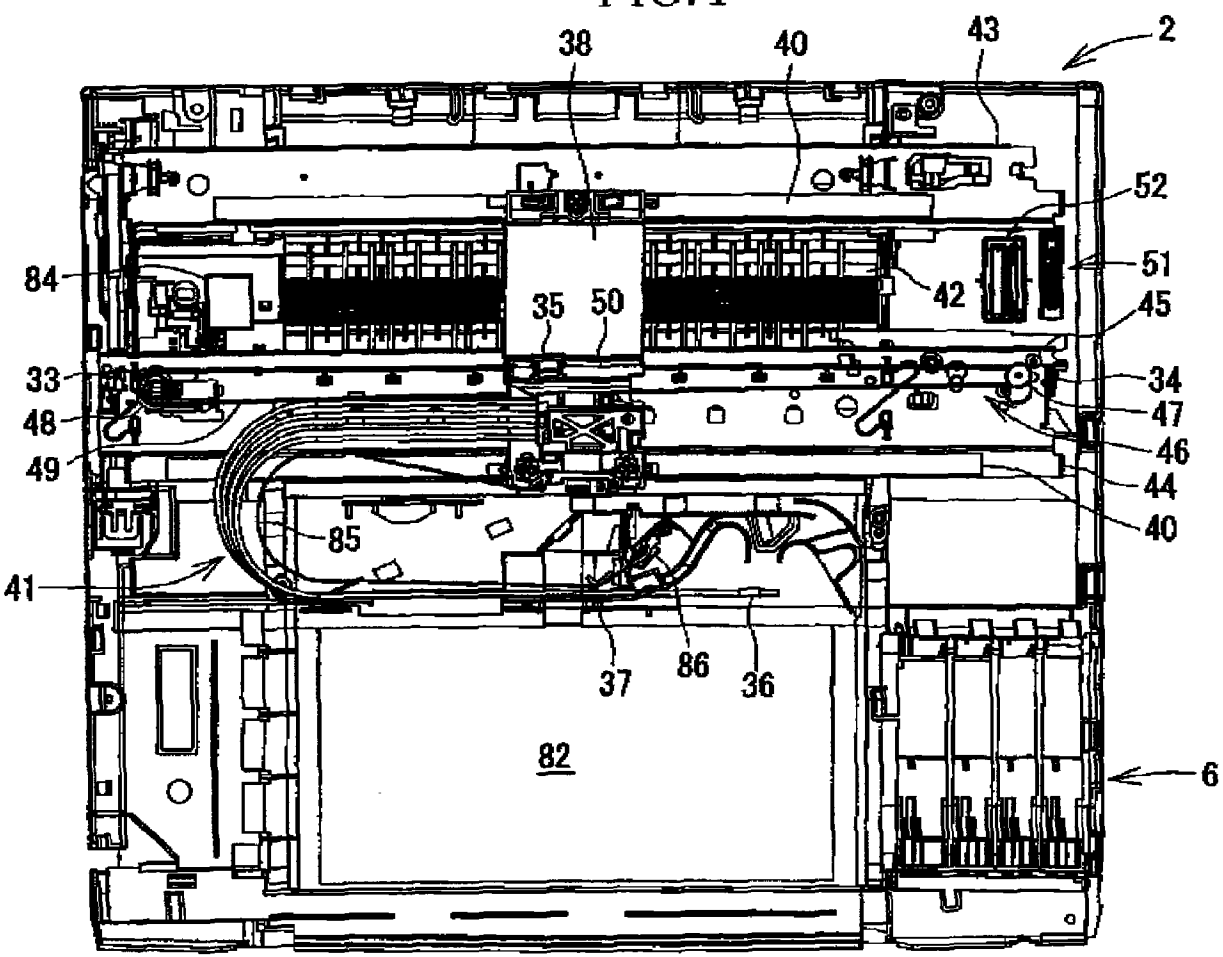
FIG. 4 is a plan view showing the relevant portion of the printer portion 2.

As shown in FIG. 3, the image recording unit 24 is provided in the sheet-convey path 23. The image recording unit 24 includes an ink-jet recording head 39, and a carriage 38 that carries the recording head 39 and can be moved or reciprocated in a main scanning direction. Four ink cartridges (not shown) are provided, in the MFD 1, at a location remote from the ink-jet recording head 39. The four ink cartridges store a cyan ink (C), a magenta ink (M), a yellow ink (Y), and a black ink (Bk), respectively, and supply those inks to the ink-jet recording head 39 via respective ink-supply tubes 41 (FIG. 4). While the carriage 38 is reciprocated, the ink-jet recording head 39 ejects fine droplets of the inks toward each recording sheet being conveyed on a platen 42 opposed to the recording head 39, so that an image is recorded on the recording sheet.

As shown in FIG. 4, the MFD 1 has two guide frames 43, 44 that are provided above the sheet-convey path 23. The two guide frames 42, 43 are distant from each other by an appropriate distance in a sheet-convey direction (i.e., a direction from top to bottom in FIG. 4), and extend in a direction perpendicular to the sheet-convey direction. The guide frames 43, 44 are provided in a casing of the printer portion 2, and constitutes a portion of a frame structure that supports various elements of the printer portion 2. The carriage 38 is supported by the two guide frames 43, 44 such that the carriage 38 bridges the two frames 43, 44 and can be slidably reciprocated in the direction perpendicular to the sheet-convey direction.

A carriage driving device 46 is provided on the downstream-side guide frame 44. The carriage driving device 46 includes an endless, annular timing belt 49 that has cogs on an inner surface thereof and is connected, at a portion thereof, to the carriage 38. The timing belt 49 is wound on a drive pulley 47 and a driven pulley 48 that are provided near the widthwise opposite ends of the sheet-convey path 23, respectively. An axis member of the drive pulley 47 is supplied with a driving power from a CR (carriage) motor (not shown), so that the drive pulley 47 is rotated and the timing belt 49 is circulated. The endless timing belt 49 may be replaced with a timing belt having opposite ends that are connected to the carriage 38.

Since the timing belt 49 is fixed to the carnage 38, when the timing belt 49 is driven or circulated, the carriage 38 is reciprocated on the two guide frames 43, 44 along an end portion 45 of the downstream-side guide frame 44. Since the ink-jet recording head 39 is mounted on the carriage 38, the recording head 39 can be reciprocated in the main scanning direction, i.e., the widthwise direction of the sheet-convey path 23.

As shown in FIGS. 3 and 4, the platen 42 is provided below the sheet-convey path 23 such that the plate 42 is opposed to the ink-jet recording head 39. The platen 42 extends over an intermediate portion of the reciprocal-movement range for the carriage 38 where each recording sheet passes. A length of the platen 42 is sufficiently greater than a width of a recording sheet of a maximum size that can be used in the MFD 1. Therefore, the widthwise opposite ends of each recording sheet can pass over the platen 42.

As shown in FIG. 4, the four ink cartridges (not shown) that store the cyan, magenta, yellow, and black inks, respectively, are detachably attached to respective cartridge accommodating portions 6 provided in a front and left portion (i.e., a right portion in FIG. 4) of the printer portion 2. FIG. 1 shows a closed state of a door 7 that can be opened and closed and that is provided in a front portion of the casing of the printer portion 2. When the door 7 is opened, the four cartridge accommodating portions 6 are exposed in the front surface of the MFD 1, so that each of the four ink cartridges can be attached to, or detached from, a corresponding one of the four cartridge accommodating portions 6. The accommodating portions 6 are provided separate from the carriage 38 on which the ink-jet recording head 39 is mounted, and the inks are supplied from the ink cartridges attached to the respective accommodating portions 6, to the recording head 39 via the respective ink-supply tubes 41.

As shown in FIG. 3, a drive roller 60 and a presser roller (not shown) as a pair of upstream-side conveying rollers that cooperate with each other to constitute a nipping portion that nips each recording sheet conveyed along the sheet-convey path 23 and conveys the recording sheet onto the platen 42, are provided on the upstream side of the image recording unit 24 with respect to the path 23. Although not shown in FIG. 3, the presser roller is provided below the drive roller 60, and is elastically biased toward the same 60. In addition, another drive roller 62 and a spur roller 63 as a pair of downstream-side conveying rollers that cooperate with each other to constitute a nipping portion that nips each recording sheet on which an image has been recorded, and convey the recording sheet toward the sheet-discharge tray 21, are provided on the downstream side of the image recording unit 24 with respect to the sheet-convey path 23. The two drive rollers 60, 62 are driven or rotated by an LF (line-feed) motor (not shown), and the recording sheet, nipped by the first drive roller 60 and the presser roller, is intermittently conveyed, on the platen 42, in incremental amounts each corresponding to one image line recorded on the sheet. The respective rotations of the two drive rollers 60, 62 are synchronized with each other, and the first drive roller 60 is provided with a rotary encoder (not shown). The rotary encoder includes an encoder disc fixed to an axis portion of the first drive roller 60, and a photo interrupter that detects slits of the encoder disc and produces pulse signals corresponding to the detected slits. Thus, the respective rotations of the two drive rollers 60, 62 are controlled by a control device (not shown), based on the thus produced pulse signals. The two pairs of conveying rollers 60, 62, 63 cooperate with each other to constitute another portion of the sheet moving device.

The spur roller 63 is slidably movable toward, and away from, the drive roller 62, and is elastically biased by a coil spring against the drive roller 62 so as to press, with an appropriate pressing force, the same 62. Since the spur roller 63 is pressed against each recording sheet on which an image has been recorded, the spur roller 63 has, like a spur, a plurality of projections on an outer circumferential surface thereof, so as not to deteriorate the image recorded on the recording sheet. When the drive roller 62 and the spur roller 63 cooperate with each other to nip the recording sheet, the spur roller 63 is elastically retracted by an amount corresponding to the thickness of the recording sheet. Thus, the rotating force of the drive roller 62 is reliably transmitted to the recording sheet. This is true with the presser roller that cooperates with the first drive roller 60.

As shown in FIG. 4, the MFD 1 includes a main substrate 82 that is provided in the front portion thereof and that supplies, e.g., recording signals to the ink-jet recording head 39 via a flat cable 85. The flat cable 85 is a belt-like member including conductors that transmit respective electric signals; and a synthetic-resin film such as a polyester film that covers the conductors to electrically insulate the same, and electrically connects between the main substrate 82 and a control substrate (not shown) of the ink-jet recording head 39. The flat cable 85 is first led out of the carriage 38 such that the upper and lower flat surfaces thereof extend in a horizontal direction, and then is curved like the letter of "U" in its plan view in a space present inside the ink tubes 41. Moreover, the flat cable 85 is fixed to a clip 86, and is extended to the main substrate 82. Since the U-shaped portion of the flat cable 85 is not fixed to any members, the U-shaped portion can change, like the ink tubes 41, its shape to follow the reciprocal movements of the carriage 38.

Hereinafter, the outer guide 18 and the guide rollers 16 are described in detail by reference to FIGS. 5 through 11.

Figure 5:
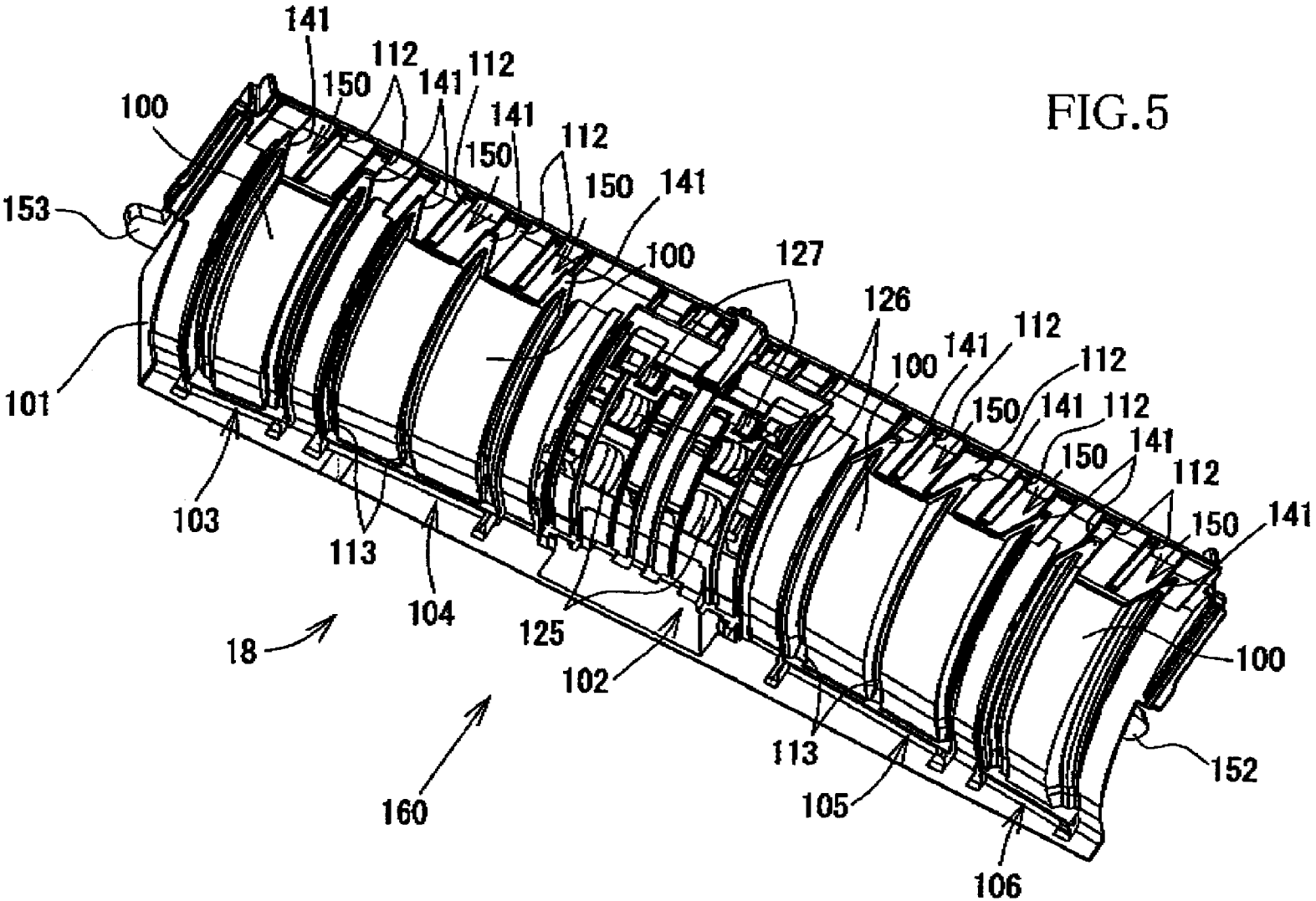
FIG. 5 is a perspective view showing a construction of an outer guide 18.
Figure 6:
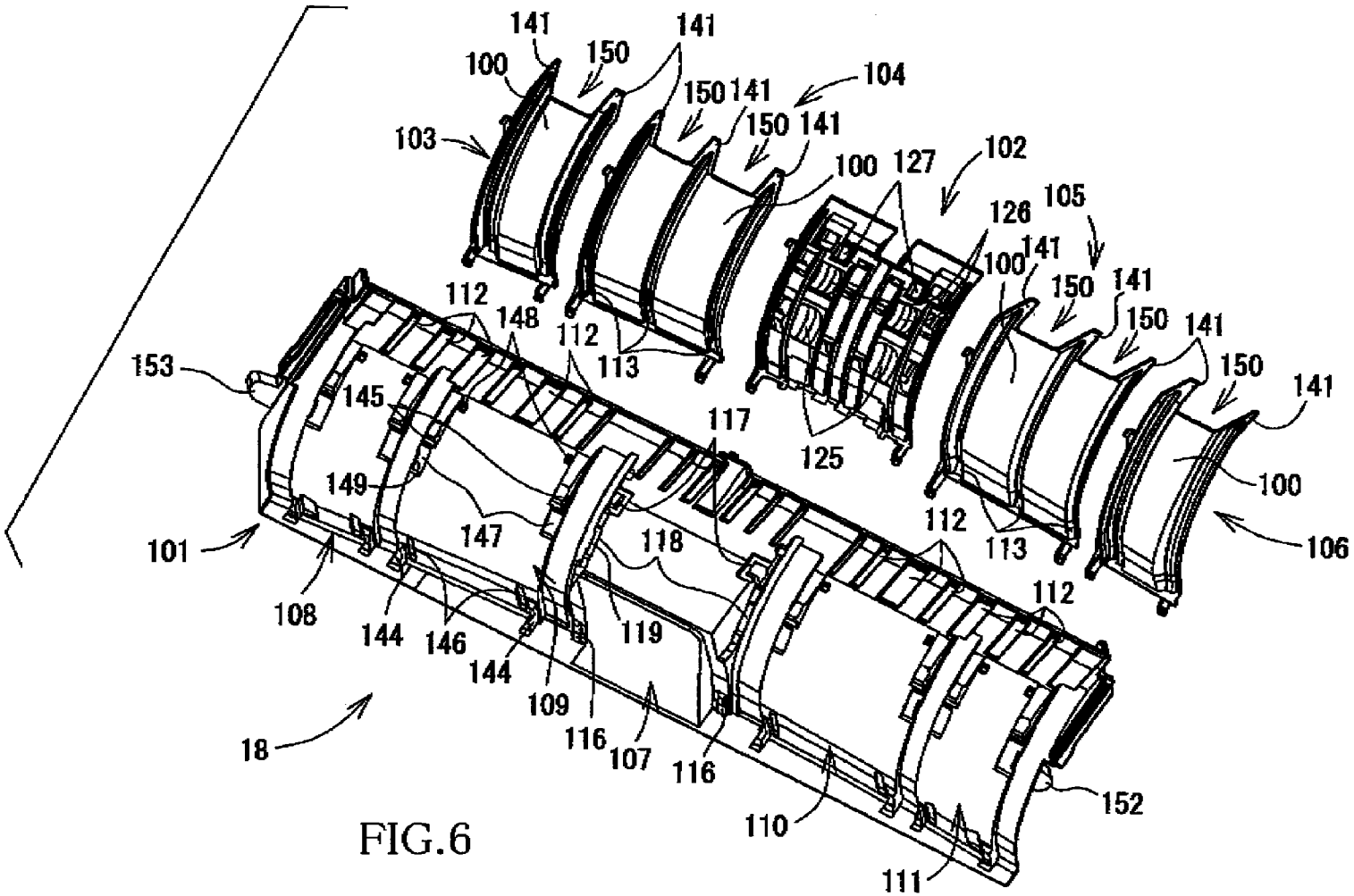
FIG. 6 is an exploded, perspective view of the outer guide 18.
Figure 9:
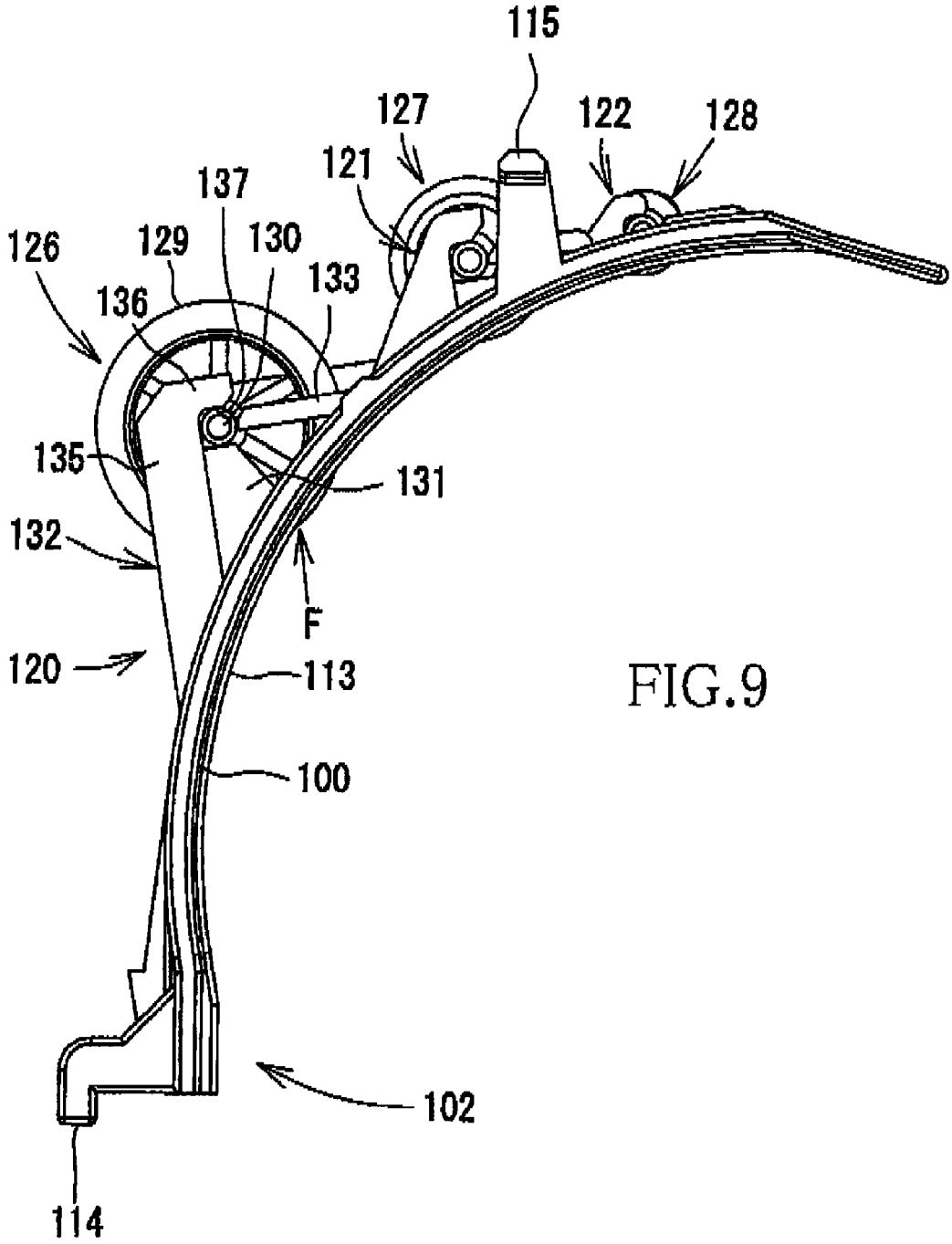
FIG. 9 is a side elevation view of the guide cover 102.

As shown in FIG. 3, the outer guide 18 constitutes the outer portion of the curved portion 17 of the sheet-convey path 23, and guides the movement of each recording sheet. As shown in FIGS. 5, 6, and 9, the outer guide 18 has a composite first guide surface that is constituted by a plurality of individual first guide surfaces 100 each of which has, in a side view of the outer guide 18, a generally arcuate shape along the curved portion 17. The outer guide 18 includes a guide base 101, and a guide cover 102 and four guide plates 103, 104, 105, 106 each of which is attachable to, and detachable from, the guide base 101 without using a tool such as a screwdriver. Each of the guide cover 102 and the four guide plates 103, 104, 105, 106 constitutes a curved plate. The guide cover 102 corresponds to a middle curved plate; the two guide plates 103, 104 correspond to one group of side plates; and the two guide plates 103, 104 correspond to another group of side plates The guide base 101 supports or holds the guide cover 102 and the four guide plates 103 through 106, and is detachably attached to the frame structure of the MFD 1. The guide base 101 is formed of a synthetic resin that is more advantageous with respect to formability and external appearance than with respect to frictional resistance. The individual first guide surfaces 100 that contact and guide each recording sheet are defined by the guide cover 102 and the four guide plates 103 through 106. Hence, the guide cover 102 and the four guide plates 103 through 106 are each formed of a synthetic resin that has a low frictional resistance. On the other hand, since the guide base 101 does not contact each recording sheet so much, the guide base 101 is formed of the resin advantageous with respect to the formability and the appearance, as described above. For example, the guide cover 102 and the guide plates 103 through 106 are each formed of polyacetal (POM) or a fluororesin as a synthetic resin that exhibits a low frictional resistance with respect to a recording sheet such as a glossy sheet; and the guide base 101 is formed of ABS (acrylonitrile butadiene styrene) or high-impact polystyrene (HIPS).

Figure 11:
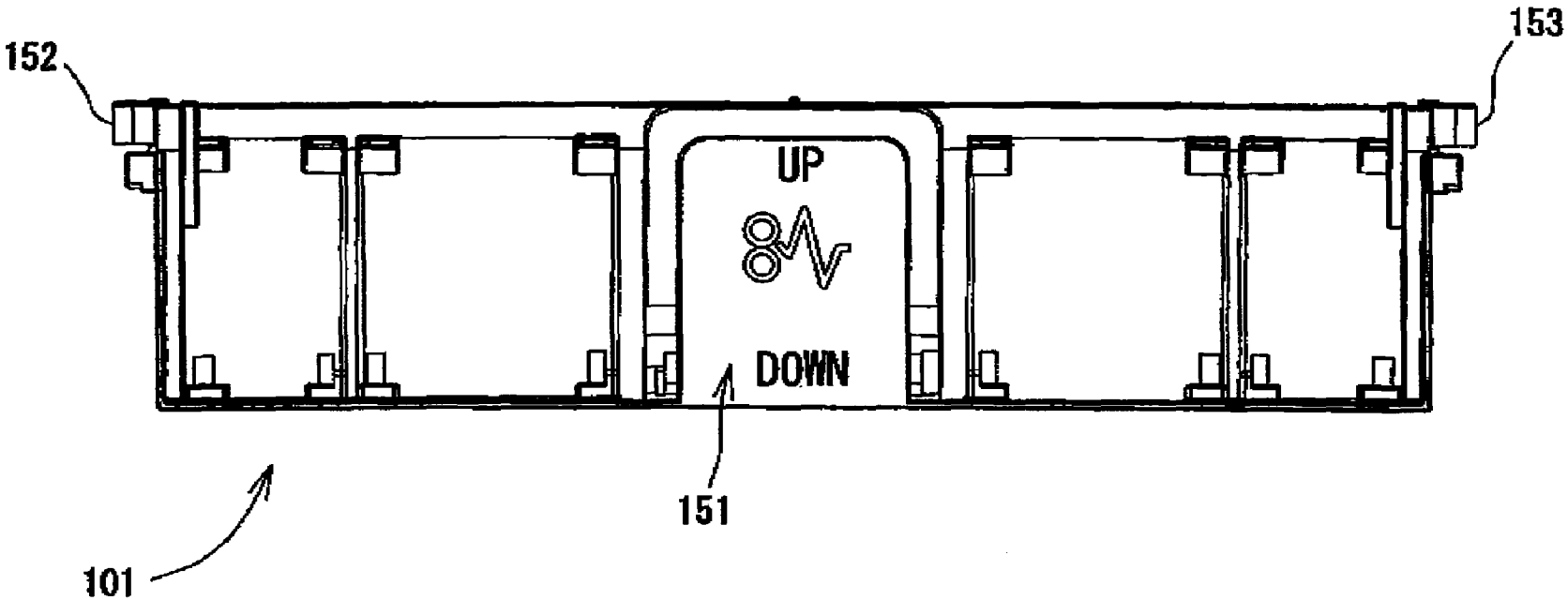
FIG. 11 is a rear elevation view of a guide base 101 of the outer guide 18, as viewed along an arrow 160 in FIG. 5.

FIG. 11 is a view of the guide base 101 taken along an arrow 160 shown in FIG. 5, i.e., shows a rear or back surface of the guide base 101. The outer guide 18 is attached to, and detached from, the frame structure of the MFD 1 in horizontal directions in the rear side of the MFD 1, i.e., the right-hand side in FIG. 3. For example, when jamming occurs in the MFD 1, the outer guide 18 can be detached from, and then attached to, the MFD 1 by a user. For the user to be able to easily detach and attach the guide member 18, the guide base 101 is assembled with the frame structure of the MFD 1 using, e.g., so-called "snap fits", not shown. As shown in FIG. 11, the guide base 101 has, in a middle portion 151 of the rear surface thereof that faces rearward when the outer guide 18 is attached to and detached from the MFD 1, printed characters "UP" pointing an upper end of the middle portion 151 and printed characters "DOWN" pointing a lower end of the same 151.

The guide base 101 has two lugs 152, 153 that project horizontally from opposite ends of an upper end portion thereof that are opposite to each other in the widthwise direction of the sheet-convey path 23. When the outer guide 18 is attached to the MFD 1, the user grips the two lugs 152, 153 of the guide base 101, such that a longitudinal axis of the guide base 101 is horizontal, and inserts the guide base 101 in a horizontal direction so as to attach the same 101 to the frame structure of the MFD 1 through the rear side of the MFD 1. Since the guide base 101 holds, on a front or inner side thereof, the guide cover 102 and the four guide plates 103 through 106, the user can naturally understand that the outer guide 18 should be attached to the MFD 1 in such a manner that the guide cover 102 and the guide plates 103 through 106 face the inner side of the MFD 1. In addition, since the MFD 1 has the flat shape in which the length and width thereof are greater than the height thereof, the user can naturally understand that the outer guide 18 should be attached to the frame structure of the MFD 1 in such a manner that the longitudinal axis of the outer guide 18 is kept horizontal.

On the other hand, in the state in which the longitudinal axis of the outer guide 18 is kept horizontal, the user cannot readily judge whether the current upper and lower ends of the guide plate 18 are correct. For example, when jamming occurs to the MFD 1, the user can detach the outer guide 18 from the frame structure of the MFD 1, and keeps the outer guide 18 on a desk or a floor while the jamming is treated. After the jamming has been treated, the outer guide 18 is attached again to the MFD 1. Since the outer guide 18 is detached from the MFD 1 and is kept at a different place while the user treats the jamming, the user may forget the posture of the guide member 18 when the guide member 18 was detached from the MFD 1.

However, as described above, the guide base 101 has, in the middle portion 151 of the rear surface thereof, the printed characters "UP", "DOWN". Therefore, when the user grips the lugs 152, 153 of the guide base 101 such that the longitudinal axis of the outer guide 18 is horizontal, the user can readily judge whether the current upper and lower ends of the guide plate 18 are correct. Thus, the user can assuredly attach the outer guide 18 to the MFD 1 such that the guide member 18 has the correct posture. However, the English words "UP", "DOWN" may be changed to other languages that are appropriate for the countries where the MFDs 1 are used. One of the two words may be omitted so long as the user can easily judge whether the current upper and lower ends of the outer guide 18 are correct. The characters may be replaced with one or more symbols such as an arrow.

The guide base 101 has, on the inner side thereof and in a generally middle portion thereof in the widthwise direction of the sheet-convey path 23, a roller-accommodating recessed portion 107 that partly accommodates the guide rollers 16. That is, the roller-accommodating recessed portion 107 accommodates the guide cover 102 holding the guide rollers 16. The guide cover 102 and the guide rollers 16 will be described later. In addition, the guide base 101 has, on either side of the roller-accommodating recessed portion 107 in the widthwise direction of the sheet-convey path 23, four guide-plate holding portions 108, 109, 110, 111. The four guide-plate holding portions 108 through 111 hold the four guide plates 103 through 106, respectively. The guide-plate holding portions 108 through 111 and the guide plates 103 through 106 will be also described later.

The guide base 101 has, at a downstream-side end thereof in the sheet-convey direction, a plurality of second guide surfaces 112 that guide each recording sheet toward the nipping portion of the first drive roller 60 and the presser roller that are provided on the downstream side of the outer guide 18 in the sheet-convey direction. Since the first drive roller 60 and the presser roller cooperate with each other to convey each recording sheet over the platen 42 when the image recording unit 24 records an image on the recording sheet, the nipping portion thereof exhibits a great nipping force so as to convey accurately the recording sheet. In addition, the MFD 1 may carry out a registering operation in which a leading end of each recording sheet conveyed from the sheet-supply tray 20 is registered by the nipping portion of the first drive roller 60 and the presser roller that are kept stopped or are being rotated in a reverse direction opposite to a forward direction corresponding to the sheet-convey direction. In order to prevent jamming of each recording sheet, it is desirable to convey accurately the leading end of the recording sheet to the nipping portion. As described previously, since the guide base 101 can be formed of the material that is more advantageous with respect to the formability and the appearance than with respect to the frictional resistance, the second guide surfaces 112 can be formed with high dimension accuracy.

Figure 7:
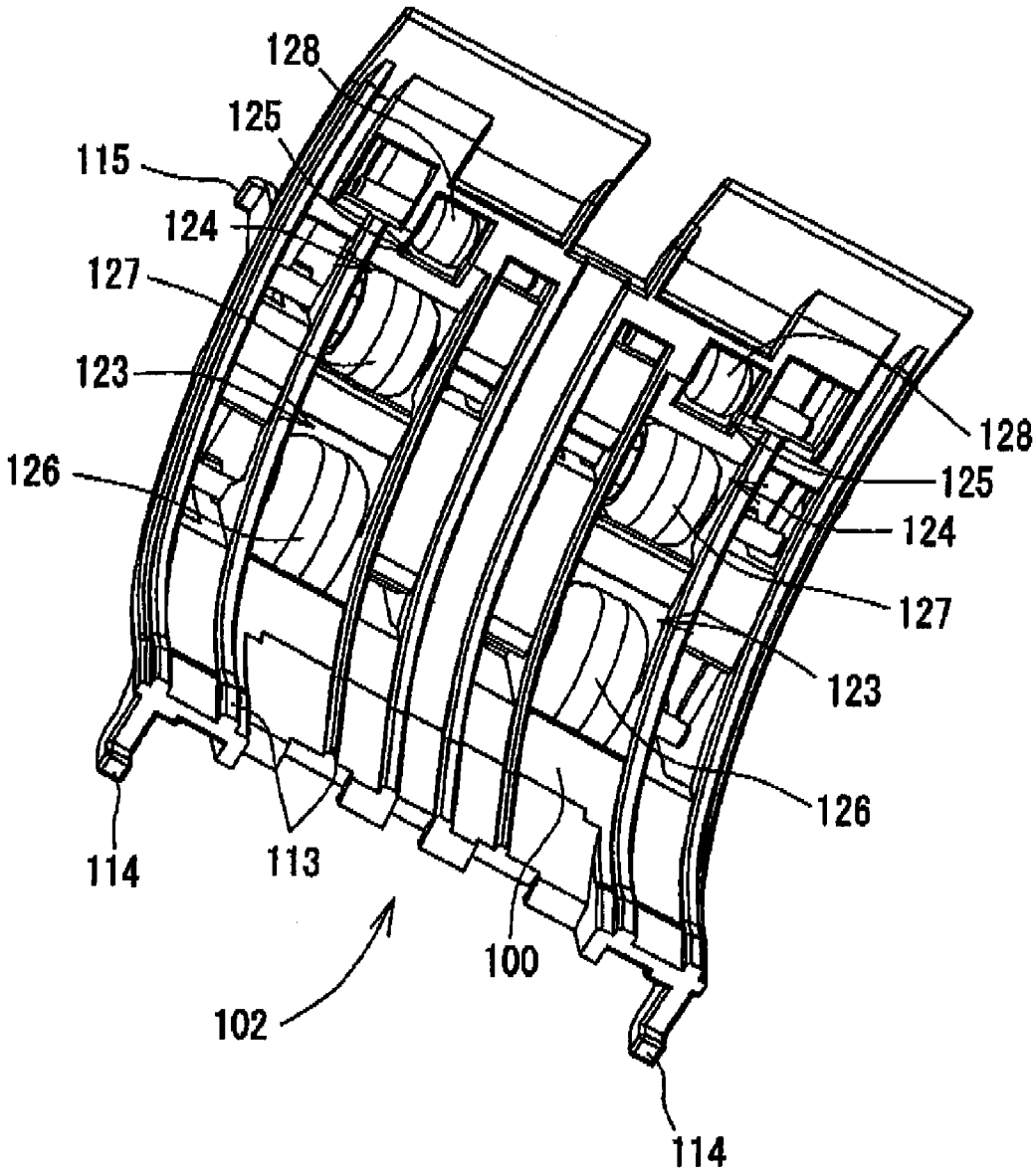
FIG. 7 is a perspective view showing a first guide surface of a guide cover 102 of the outer guide 18.

As shown in FIGS. 5 and 6, the guide cover 102 holding the guide rollers 16 is attachable to the roller-accommodating recessed portion 107 of the guide base 101. As shown in FIG. 7, an inner surface of the guide cover 102 provides one of the individual first guide surfaces 100 that contact and guide each recording sheet. As described previously, the guide cover 102 is formed of the synthetic resin whose frictional resistance or coefficient is smaller than that of the outer surfaces (e.g., the second guide surfaces 112) of the guide base 101. Therefore, the guide cover 102 exhibits a small frictional resistance with respect to each of the recording sheets, in particular, surface-treated recording sheets such as glossy sheets. Thus, each recording sheet can be smoothly conveyed along the first guide surface 100 of the guide cover 102.

The guide cover 102 has a plurality of guide ribs 113 that project from the individual first guide surface 100 thereof and extend in the sheet-convey direction, such that the guide ribs 113 are symmetrical with each other with respect to a center-line of the sheet-convey path 23. Since the guide ribs 113 are formed on the first guide surface 100, a total area of contact of each recording sheet with the first guide surface 100 is largely decreased and accordingly a friction produced between the recording sheet and the guide surface 100 when the sheet is conveyed is largely lowered. In a strict meaning, respective top surfaces of the guide ribs 113 cooperate with each other to define the individual first guide surface 100 of the guide cover 102.

Figure 8:
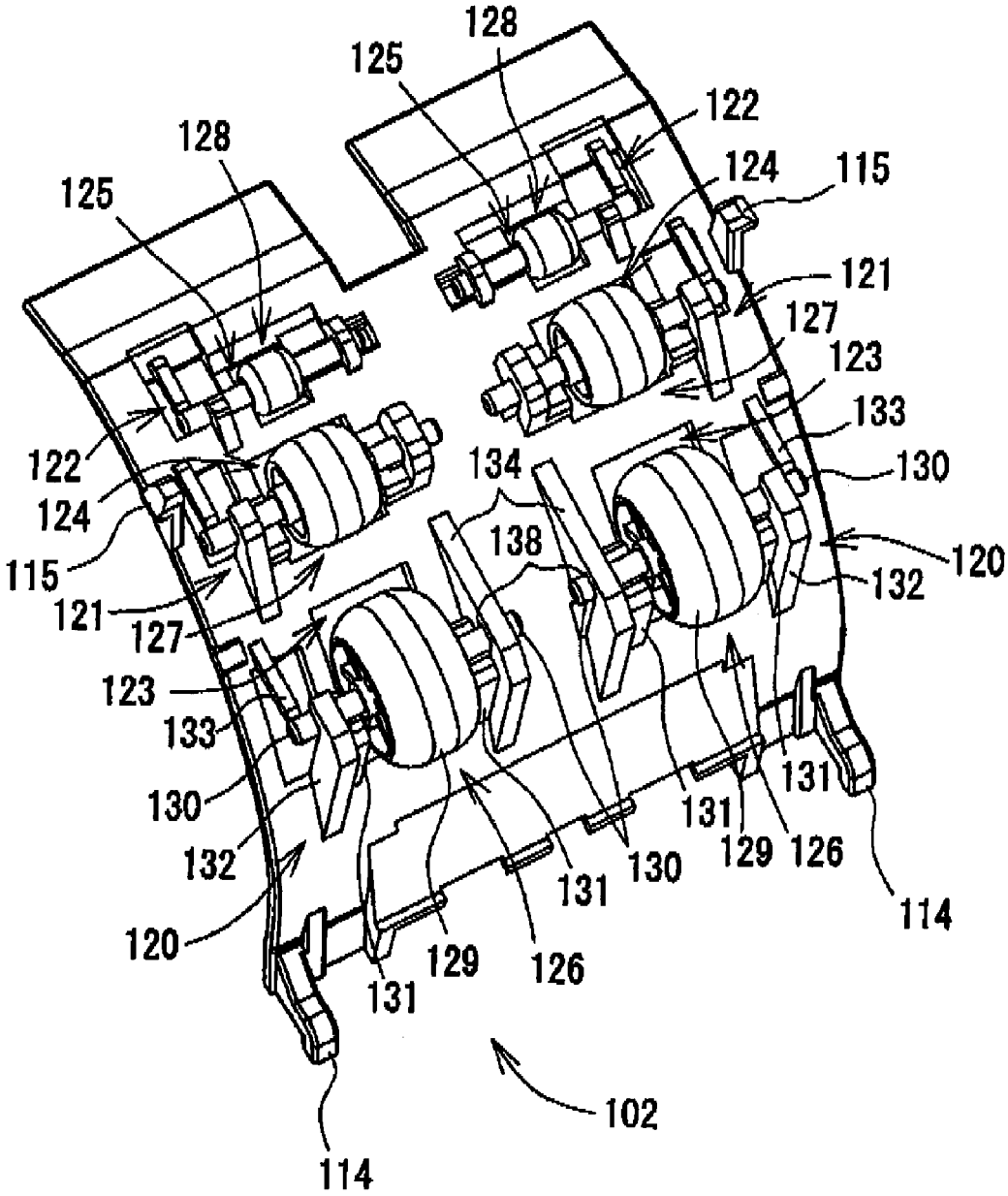
FIG. 8 is a perspective view showing a rear surface of the guide cover 102.

As shown in FIGS. 7 and 8, the guide cover 102 has, at widthwise opposite ends thereof, two pairs of engageable projections 114, 115. Each of the two first engageable projections 114 has an L-shaped cross section and projects rearward from an upstream-side end portion of the guide cover 102 as seen in the sheet-convey direction. A free end portion of each first engageable projection 114 projects from a base portion thereof in a direction opposite to the sheet-convey direction. Each of the two second engageable projections 115 also has an L-shaped cross section and projects rearward from an intermediate portion of the guide cover 102 as seen in the sheet-convey direction. A free end portion of each second engageable projection 115 projects from a base portion thereof in an outward direction parallel to a widthwise direction of the guide cover 102.

As shown in FIG. 6, the roller-accommodating recessed portion 107 of the guide base 101 has two pairs of engageable recesses 116, 117 corresponding to the two pairs of engageable projections 114, 115, respectively. In the present embodiment, each of the four engageable recesses 116, 117 is provided by a through-hole formed through a thickness of the roller-accommodating recessed portion 107. However, each engageable recess 116, 117 may not be a through-hole so long as the each engageable recess 116, 117 can engage the corresponding engageable projection 114, 115.

The guide cover 102 is attached to the roller-accommodating recessed portion 107 of the guide base 101 in such a manner that the four engageable projections 114, 115 are engaged with the four engageable recesses 116, 117, respectively. The roller-accommodating recessed portion 107 has two abutment surfaces 118 that are provided at widthwise opposite end portions of the recessed portion 107, respectively, and cooperate with each other to abut on (or support) a rear surface of the guide cover 102. Since the two abutment surfaces 118 abut on the rear surface of the guide cover 102, the guide cover 102 is prevented from being moved relative to the guide base 101 in an outward direction of the first curved guide surface 100 that is perpendicular to a tangential plane of the same 100. Since the four engageable projections 114, 115 are engaged with the four engageable recesses 116, 117, respectively, in the state in which the rear surface of the guide cover 102 is supported by the two abutment surfaces 118, the guide cover 102 is firmly fixed to the guide base 101 in such a manner that the respective free end portions of the four engageable projections 114, 115 are elastically deformed and accordingly are biased by respective elastically restoring forces thereof against the guide base 101. Thus, the guide cover 102 is prevented from being moved inward of the first curved guide surface 100 thereof relative to the guide base 101. Thus, the guide cover 102 is accurately positioned relative to the guide base 101, while distortions of peripheral portions of the guide cover 102, if any, are corrected. The total number and/or locations of the abutment surfaces 118 are not limited. The present embodiment is advantageous because the abutment surfaces 118 are provided at the locations corresponding to the end portions of the guide cover 102 where distortions or dimensional errors are likely to occur. Therefore, the abutment surfaces 118 may be provided at locations that are distant from each other in the sheet-convey direction.

The roller-accommodating recessed portion 107 additionally has one abutment surface 119 that is provided at one of the widthwise opposite end portions of the recessed portion 107, and abuts on a side surface of the guide cover 102. Since the abutment surface 119 abuts on, and stops, the side surface of the guide cover 102, the guide cover 102 is prevented from being moved in the widthwise direction of the guide base 101. Therefore, the guide cover 102 is effectively prevented from rattling relative to the roller-accommodating recessed portion 107, and is accurately positioned relative to the guide base 101. Thus, the first curved guide surface 100 of the guide cover 102 is made substantially flush with the respective first curved guide surfaces 100 of the four guide plates 103 through 106. In the present embodiment, one abutment surface 119 is provided at the location corresponding to one of the widthwise opposite end portions of the roller-accommodating recessed portion 107. However, another abutment surface 119 may be provided at a location corresponding to the other of the widthwise opposite end portions of the roller-accommodating recessed portion 107, or two abutment surfaces 119 may be provided at locations that are distant from each other in the sheet-convey direction.

As shown in FIG. 8, the guide cover 102 has, on the rear surface thereof, three pairs of bearing portions 120, 121, 122 that bear three pairs of guide rollers 16 (126, 127, 128), respectively, such that the guide rollers 126, 127, 128 are freely rotatable. The guide cover 102 additionally has three pairs of through-holes 123, 124, 125 such that the three pairs of through-holes 123, 124, 125 are distant from each other in the sheet-convey direction and are symmetric with each other with respect to a centerline of the guide cover 102. The three pairs of through-holes 123, 124, 125 are formed through a thickness of the guide cover 102, and respective outer circumferential surfaces of the guide rollers 126, 127, 128 are partly exposed through the corresponding through-holes 123, 124, 125 toward the inner side of the curved guide cover 102. Thus, the three pairs of bearing portions 120, 121, 122 correspond to the three pairs of through-holes 123, 124, 125, respectively.

The three pairs of guide rollers 126, 127, 128 have different outer diameters. Since the three pairs of guide rollers 126, 127, 128 are similar to each other except for the different outer diameters thereof, the pair of guide rollers 126 each having the greatest diameter will be described below as a representative of the three pairs of guide rollers 126, 127, 128. As shown in FIGS. 8 and 9, each of the two guide rollers 126 includes a roller body 129 and a pair of shaft portions 130 all of which are formed as an integral body. The pair of shaft portions 130 cooperate with each other to constitute a shaft of each guide roller 126. Like the guide cover 102, each guide roller 126 is formed of the synthetic resin that has the lower frictional resistance than that of the guide base 101. The roller body 129 has a generally cylindrical shape, and the outer circumferential surface thereof contacts each recording sheet. The two shaft portions 130 project outward from opposite ends of the roller body 129, respectively.

The three pairs of bearing portions 120, 121, 122 bear the three pairs of guide rollers 126, 127, 128, respectively, such that the three pairs of guide rollers 126, 127, 128 are freely rotatable and partly project from the three pairs of through-holes 123, 124, 125, respectively. Since the three pairs of bearing portions 120, 121, 122 are similar to each other except for different sizes thereof corresponding to the different sizes of the three pairs of guide rollers 126, 127, 128, the pair of bearing portions 120 that bear the pair of guide rollers 126 each having the greatest diameter will be described below as a representative of the three pairs of bearing portions 120, 121, 122.

As shown in FIGS. 8 and 9, each of the two bearing portions 120 includes two base portions 131, an L-shaped holding portion 132, a locking-up portion 133, and a bearing rib 134. The two base portions 131 of each bearing portion 120 are constituted by two ribs, respectively, that project rearward from around opposite ends of a corresponding one of the two through-holes 123. Respective top surfaces of the two base portions 131 of each bearing portion 120 position the two shaft portions 130 of a corresponding one of the two guide rollers 126, respectively, with respect to an inward direction of the first curved guide surface 100 of the guide cover 102. The respective top surfaces of the two base portions 131 are not limited to any particular shapes, so long as they can support the shaft portions 130. For example, those top surfaces may be flat, stepped, or grooved.

The L-shaped holding portion 132 and the bearing rib 134 are provided adjacent the two base portions 131, respectively, such that the L-shaped holding portion 132 and the bearing rib 134 are opposed to each other on either side of the through-hole 123. As shown in FIG. 9, the L-shaped holding portion 132 includes a stem portion 135 that projects from the rear surface of the guide cover 102 in an outward direction of the first curved guide surface 100 thereof; and a hook portion 136 that extends substantially perpendicularly from a top end of the stem portion 135. The L-shaped holding portion 132 positions one of the two shaft portions 130 such that the one shaft portion 130 is held in contact with respective inner surfaces of the stem portion 135 and the hook portion 136.

The inner surface of the hook portion 136 provides a bearing surface 137. The bearing surface 137 extends substantially perpendicularly to a direction in which the guide roller 126 receives a load, F, from each recording sheet being conveyed. As shown in FIG. 9, each recording sheet is guided by the outer guide 18 such that a leading end of the sheet is slid on the first curved guide surface 100 and the curved guide ribs 113 while the sheet is conveyed in an upward direction in FIG. 9. When the leading end of the recording sheet contacts the guide roller 126, the guide roller 126 receives the load F. The direction in which the guide roller 126 receives the load F substantially coincides with the direction in which the leading end of the recording sheet advances. The bearing surface 137 of the hook portion 136 is substantially perpendicular to the direction in which the guide roller 126 receives the load F, and accordingly the bearing surface 137 can receive the load F.

The bearing surface 137 and the top surface of a corresponding one of the two base portions 131 cooperate with each other to define a space that can accommodate and bear the one shaft portion 130 of the guide roller 126 such that the shaft portion 130 is freely rotatable. In the state in which this space bears the shaft portion 130, the guide roller 126 is positioned with respect to each of the opposite directions of the first curved guide surface 100 that are perpendicular to the tangential plane of the same 100. Thus, the bearing surface 137 and the corresponding base portion 131 cooperate with each other to bear the shaft portion 130 of the guide roller 126 such that the shaft portion 130 is freely rotatable.

As shown in FIG. 8, the bearing rib 134 that is opposed to the L-shaped holding portion 132 projects from the rear surface of the curved guide cover 102 in the outward direction thereof. The bearing rib 134 has a bearing hole 138 formed through a thickness thereof. The other shaft portion 130 of the guide roller 126 is inserted into the bearing hole 138, and is supported by the top surface of the other base portion 131 remote from the L-shaped holding portion 132. Thus, the other shaft portion 130 of the guide roller 126 is freely rotatably borne at an appropriate position. In the present embodiment, each bearing portion 120 is formed such that the L-shaped holding portion 132 thereof is located in a peripheral area of the guide cover 102 and the bearing rib 134 is located in a central area of the same 102. However, the relative-positional relationship between the L-shaped holding portion 132 and the bearing rib 134 has no particular limitations. The bearing rib 134 may be replaced with another L-shaped holding portion 132 provided adjacent the base portion 131, so that the two L-shaped holding portions 132 cooperate with each other to bear the two shaft portions 130 of the guide roller 126.

The locking-up portion 133 is constituted by an elastically deformable bar-like portion that extends from the rear surface of the guide cover 102 toward the hook portion 136 of the L-shaped holding portion 132 such that a free end of the locking-up portion 133 is located at a position near the hook portion 136 where the free end can engage the one shaft portion 130 held by, and between, the L-shaped holding portion 132 and the one base portion 131. Thus, the one shaft portion 130 is positioned by the locking-up portion 133, the L-shaped holding portion 132, and the one base portion 131, such that the one shaft portion 130 does not come off the guide cover 102. When the one shaft portion 130 of the guide roller 126 is inserted into the space between the hook portion 136 of the L-shaped holding portion 132 and the one base portion 131, the locking-up portion 133 is elastically deformed toward the rear surface of the guide cover 102, so as to open the space. After the one shaft portion 130 is received by the space, the locking-up portion 133 is elastically returned to its original shape or posture. As described above, the bearing surface 137 of the L-shaped holding portion 132 is substantially perpendicular to the direction in which the guide roller 126 receives the load F upon engagement thereof with each recording sheet being conveyed. Therefore, the locking-up portion 133 is not elastically deformed by the load F and accordingly the one shaft portion 130 of the guide roller 126 does not come off the space provided between the hook portion 136 of the L-shaped holding portion 132 and the one base portion 131.

In this way, each of the two bearing portions 120 bears the shaft portions 130 of a corresponding one of the two guide rollers 126, such that the shaft portions 130 are freely rotatable. Each bearing portion 120 is formed integrally with the guide cover 102 and, as described above, the guide cover 102 and the guide rollers 126 are formed of the synthetic resin having the lower frictional resistance than that of the guide base 101. Therefore, the guide rollers 126 can be smoothly rotated in the state in which the rollers 126 are borne by the bearing portions 120. Thus, the friction produced by the guide rollers 126 can be effectively reduced.

Each guide roller 126 is borne by the corresponding bearing portion 120 such that the shaft portions 130 thereof are positioned with respect to the inward direction of the first curved guide surface 100 of the guide cover 102, more specifically described, the roller body 129 thereof projects inward from the first curved guide surface 100 by a distance or height greater than a distance or height by which the guide ribs 113 project. Thus, each recording sheet that has been conveyed along the guide ribs 113 inevitably engages the respective roller bodies 129 of the two guide rollers 126. When the two guide rollers 126 receive the load F from the recording sheet, those rollers 126 are rotated about the respective axes of the pairs of shaft portions 130 thereof, so that the recording sheet is conveyed downstream without contacting the guide ribs 113 around the rollers 126.

In addition, since each guide roller 126 is constituted by the roller body 129 and the shaft portions 130 that are integral with each other, the dimensional tolerance of each guide roller 126 can be lowered as compared with a case where the roller body 129 and the shaft portions 130 are constituted by a roller body and a shaft as separate members, because in the latter case the roller body needs to be rotated relative to the shaft. On the other hand, in another case where the shaft portions 130 are borne by being held between the guide cover 102 and the roller-accommodating recessed portion 107, the position of the guide roller 126 is influenced by the respective tolerances of the two members 102, 107. In contrast, in the present embodiment, the roller body 129 and the shaft portions 130 are formed integrally with each other, and the shaft portions 130 are positioned by the bearing portion 120 that is formed integrally with the guide cover 102. Therefore, the error of positioning of each guide roller 126 that would otherwise be increased by the accumulation of tolerances of the separate members can be decreased. Thus, the position of each guide roller 126, in particular, the position of the roller body 129 relative to the guide ribs 113 can be kept with high accuracy.

The other, two pairs of bearing portions 121, 122 than the pair of bearing portions 120 have respective structures similar to that of the pair of bearing portions 120 and, like the pair of bearing portions 120, the two pairs of bearing portions 121, 122 bear the two pairs of guide rollers 127, 128, respectively, such that those guide rollers 127, 128 are freely rotatable, although the detailed description thereof is omitted. Therefore, the guide rollers 127, 128 are borne and positioned by the bearing portions 121, 1222 such that the roller bodies 129 thereof project from the first curved guide surface 100 by respective distances greater than the distance by which the guide ribs 113 project. Thus, each recording sheet that has been conveyed along the guide ribs 113 inevitably engages the respective roller bodies 129 of the guide rollers 126, 127, 128 and, as those roller bodies 129 rotate, the recording sheet is conveyed downstream along the sheet-convey path 23.

The three pairs of guide rollers 126, 127, 128 are supported by the guide cover 102 such that the pairs of guide rollers 126, 127, 128 are distant from each other in the sheet-convey direction. Therefore, each recording sheet can be smoothly conveyed along the first curved guide surface 100 of the guide cover 102, while the recording sheet is curved or flexed along the same 100 and is sequentially guided by the pairs of guide rollers 126, 127, 128.

The respective roller bodies 129 of the most upstream pair of guide rollers 126 with respect to the sheet-convey direction have the largest diameter; and the respective roller bodies 129 of the most downstream pair of guide rollers 128 have the smallest diameter. If the respective roller bodies 129 of all the guide rollers 126, 127, 128 project from the guide ribs 113 by the same distance or height, it can be said that as the respective diameters of the roller bodies 129 increase, the obtuse angles contained by the guide ribs 113 and the respective outer circumferential surfaces of the roller bodies 129 approach 180 degrees. In the present embodiment, the respective obtuse angles contained by the guide ribs 113 and the respective outer circumferential surfaces of the respective roller bodies 129 of the most upstream guide rollers 126 are the nearest to 180 degrees. As those obtuse angles increase toward 180 degrees, the load F applied by the leading end of each recording sheet being guided by the guide ribs 113, to the respective outer circumferential surfaces of the roller bodies 129 decreases; on the other hand, as the obtuse angles decrease toward 90 degrees, the load F increases. That is, as the obtuse angles increase toward 180 degrees, the respective acute angles contained by the sheet-convey direction and the respective outer circumferential surfaces of the roller bodies 129 decrease, and accordingly the impact with which the leading end of each recording sheet initially engages the roller bodies 129 decreases.

Therefore, each recording sheet being conveyed along the guide ribs 113 engages, with the smallest impact, the most upstream pair of guide rollers 126. When the recording sheet engages the next pair of guide rollers 127, the leading end of the sheet has been more or less lifted up from the guide ribs 113 by the first pair of guide rollers 126. Thus, as the recording sheet advances downstream of the sheet-convey direction along the three pairs of guide rollers 126, 127, 128, the impact with which the recording sheet engages those guide rollers 126, 127, 128 decreases. Thus, the intermediate guide rollers 127 can have a smaller diameter than that of the most upstream guide rollers 126; and the most downstream guide rollers 128 can have a smaller diameter than that of the intermediate guide rollers 127. Therefore, respective distances or heights by which the guide rollers 127, 128 project from the rear surface of the guide cover 102 can be decreased, which contributes to decreasing the overall size of the outer guide 18.

The guide cover 102 with which the three pairs of guide rollers 126, 127, 128 are assembled is attached to the roller-accommodating recessed portion 107 of the guide base 101. The guide rollers 126, 127, 128 are borne by the bearing portions 120, 121, 122 integrally formed with the guide cover 102, such that whatever posture may be taken by the guide cover 102, the guide rollers 126, 127, 128 do not come off the guide cover 102. Thus, the guide rollers 126, 127, 128 can be easily assembled with the guide base 101.

In the state in which the guide cover 102 is assembled with the roller-accommodating recessed portion 107 of the guide base 101, the guide rollers 126, 127, 128 are exposed in one of the first curved guide surfaces 100 of the outer guide 18, such that the respective pairs of shaft portions 130 of the guide rollers 126, 127, 128 extend in the widthwise direction of the sheet-convey path 23 that is perpendicular to the sheet-convey direction. Since the roller-accommodating recessed portion 107 is provided in the substantially middle portion of the guide base 101 in the widthwise direction of the sheet-convey path 23, the guide rollers 126, 127, 128 are provided in a substantially middle portion of the outer guide 18. As shown in FIGS. 5 and 6, the thickness of wall of the guide base 101 is greater at the middle portion thereof than the widthwise opposite end portions thereof, so that the middle portion of the guide base 101 somewhat projects into the sheet-convey path 23. Therefore, the guide cover 102 having the widthwise middle one of the first guide surfaces 100 somewhat projects into the sheet-convey path 23. Thus, the guide rollers 126, 127, 128 can surely engage each recording sheet of each size such as A4 Size, B5 Size, or Postcard Size. In particular, in the case where each recording sheet is conveyed in a so-called "center-registration" manner in which the centerline of each recording sheet is aligned with the centerline of the sheet-convey path 23, the guide rollers 126, 127, 128 can engage only a widthwise middle portion of each recording sheet and accordingly the friction produced by the guide rollers 126, 127, 128 can be effectively decreased.

When the guide rollers 126, 127, 128 engage each recording sheet, the guide rollers 126, 127, 128 are rotated in a forward direction corresponding to the sheet-convey direction, so that the recording sheet is conveyed, with a low friction, along the first guide surface 100, or the respective top surfaces of the guide ribs 113. Since each of the guide rollers 126, 127, 128 is constituted by the roller body 129 and the shaft portions 130 that are integral with each other, no noise is produced by the rattling of the roller body 129 and the shaft portions 130 relative to each other. Thus, the noise produced by the operation of the guide rollers 126, 127, 128 can be largely reduced.

As shown in FIGS. 5 and 6, the four guide plates 103, 104, 105, 106 are attached to the four guide-plate holding portions 108, 109, 110, 111 of the guide base 101, respectively. The four guide plates 103 through 106 have the respective first curved guide surfaces 100 that contact and guide each recording sheet. As described previously, the four guide plates 103 through 106 are formed of the synthetic resin whose frictional resistance is lower than that of the outer surfaces of the guide base 101. Therefore, the four guide plates 103 through 106 exhibit a low frictional resistance with respect to recording sheets, in particular, surface-treated recording sheets such as glossy sheets. Thus, each recording sheet can be smoothly conveyed along the respective first curved guide surfaces 100 of the four guide plates 103 through 106.

Since the four guide plates 103 through 106 have a similar structure except that the plates 103 through 106 have different sizes, and respective guide ribs 139 of the plates 103 through 106 have different shapes, depending on the respective positions in the widthwise direction of the guide base 101 where the plates 103 through 106 are attached to the guide base 101, the second guide plate 104 will be described below as a representative of the four guide plates 103 through 106, and the description of the other, three guide plates 103, 105, 106 is omitted.

Figure 10:
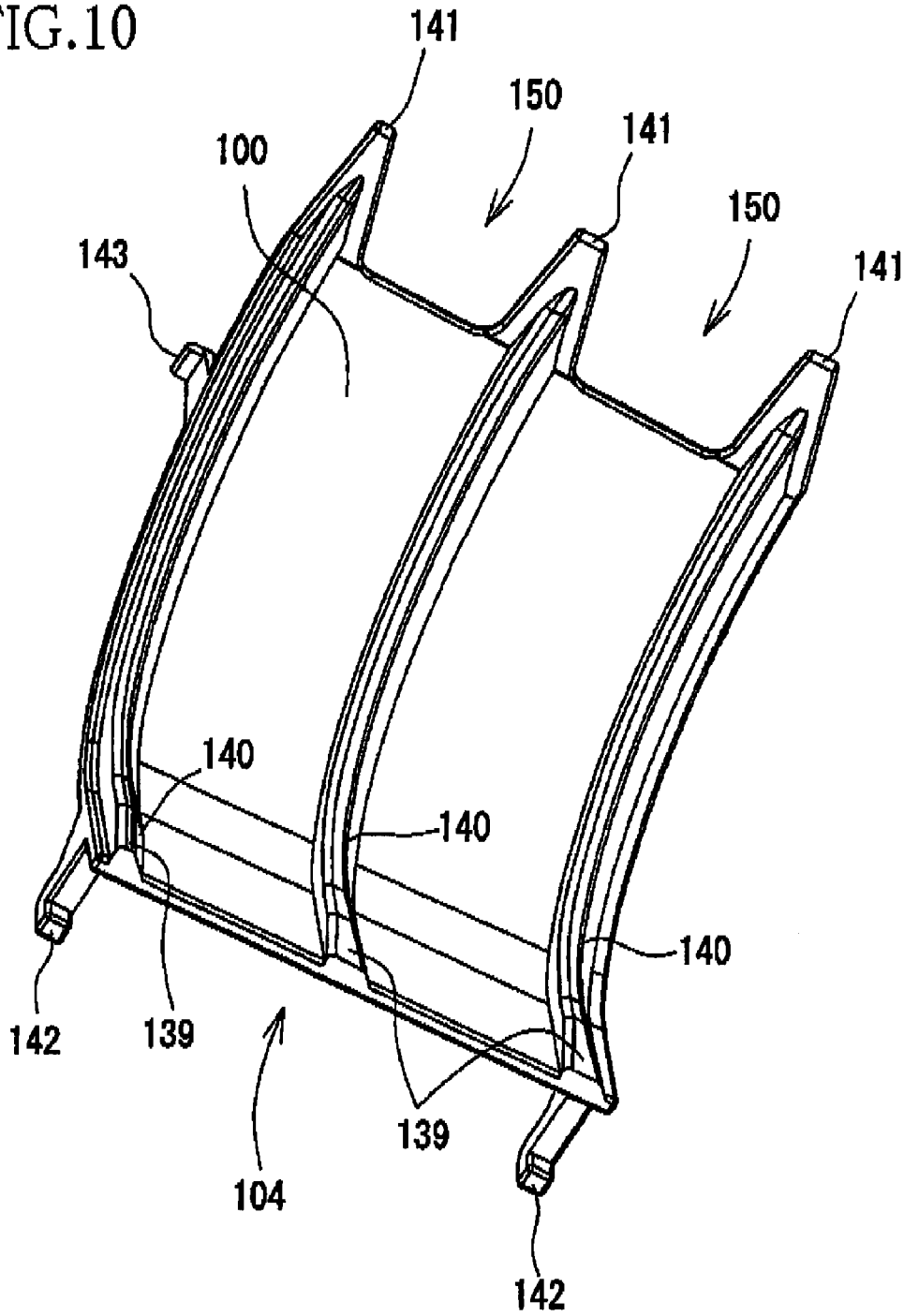
FIG. 10 is a perspective view of a guide plate 104 of the outer guide 18.

As shown in FIG. 10, the guide plate 104 has a plurality of guide ribs 133 that project from the first guide surface 100 thereof and extend in the sheet-convey direction. Each guide rib 139 has opposite side surfaces each extending in the sheet-convey direction, and one 140 of the opposite side surfaces that is nearer to the centerline of the outer guide 18 cooperates with the first guide surface 100 to contain or define an obtuse angle. Since each recording sheet is conveyed in the "center-registration" manner in which the centerline of each recording sheet is aligned with the centerline of the outer guide 18, the side surface 140 may engage a side edge of each recording sheet. Therefore, if each recording sheet is conveyed in such a manner that a side edge thereof is engaged with a side surface of a guide rib that is perpendicular to the first guide surface 100, then jamming of the sheet may occur when the sheet is conveyed in an oblique direction, or corrugation may occur to the side edge of the sheet. In contrast, in the present embodiment, since the side surface 140 defines the obtuse angle with respect to the first guide surface 100, the side edge of each recording sheet is reliably guided by the side surface 140 so as to climb easily the guide rib 139. Thus, jamming and corrugation of each recording sheet can be effectively prevented. In addition, since the guide ribs 139 are formed on the first guide surface 100, a total area of contact of each recording sheet with the first guide surface 100 is largely decreased and accordingly a friction produced between the recording sheet and the guide surface 100 when the sheet is conveyed is largely reduced.

The guide plate 104 has, at a downstream end thereof in the sheet-convey direction, a plurality of guide fins 141 that protrude downstream in the same direction. The guide fins 141 are provided at respective positions corresponding to the guide ribs 139. In the state in which the guide plate 104 is attached to the guide base 101, the guide fins 141 are located adjacent, and on an upstream side of, the second guide surface 112 of the guide base 101. The guide fins 141 are formed integrally with the guide plate 104, such that respective surfaces of the fins 141 are substantially flush with the first guide surface 100. Since each recording sheet is guided by the guide fins 141, the leading end of the sheet engages, at an appropriate angle, the second guide surface 102. Thus, since each recording sheet is guided by the guide fins 141 having the low friction resistance till the sheet reaches the corresponding second guide surface 112, the sheet can be smoothly conveyed.

As shown in FIG. 10, each pair of two adjacent guide fins 141 define a space 150 therebetween that is free of the first guide surface 100. In addition, in the state in which the guide plate 104 is attached to the guide base 101, the guide fins 141 are somewhat spaced from the guide base 101. Therefore, when each recording sheet is guided by the guide fins 141, the recording sheet is not contacted with any other members or portions than the fins 141. Therefore, the friction produced when the leading end of each recording sheet is guided by the second guide surface 112 can be decreased to a greater extent, and accordingly the recording sheet can be more accurately guided by the second guide surface 112 to the nipping portion of the first drive roller 60 and the cooperative presser roller.

The guide plate 104 has, at widthwise opposite ends thereof, two pairs of engageable projections 142, 143. Each of the two first engageable projections 142 has an L-shaped cross section and projects rearward from an upstream-side end portion of the guide plate 104 with respect to the sheet-convey direction. A free end portion of each first engageable projection 142 projects from a base portion thereof in a direction opposite to the sheet-convey direction. Each of the two second engageable projections 143 also has an L-shaped cross section and projects rearward from an intermediate portion of the guide plate 104 with respect to the sheet-convey direction. A free end portion of each second engageable projection 143 projects from a base portion thereof in an outward direction parallel to a widthwise direction of the guide plate 104.

As shown in FIG. 6, the guide-plate holding portion 109 of the guide base 101 has two pairs of engageable recesses 144, 145 corresponding to the two pairs of engageable projections 142, 143, respectively. In the present embodiment, each of the four engageable recesses 144, 145 is provided by a through-hole formed through a thickness of the guide-plate holding portion 109. However, each engageable recess 144, 145 may not be a through-hole so long as the engageable recess 144, 145 can engage the corresponding engageable projection 142, 143.

The guide plate 104 is attached to the guide-plate holding portion 109 of the guide base 101 in such a manner that the four engageable projections 142, 143 are engaged with the four engageable recesses 144, 145, respectively. The guide-plate holding portion 109 has three pairs of first abutment surfaces 146, 147, 148 that are provided at widthwise opposite end portions of the holding portion 109, respectively, and cooperate with each other to abut on, and support, a rear surface of the guide plate 104. More specifically described, the pair of first abutment surfaces 146 are provided at an upstream-side end portion of the holding portion 109 with respect to the sheet-convey direction; the pair of first abutment surfaces 147 are provided at a position distant from the pair of first abutment surfaces 146 in the sheet-convey direction; and the pair of first abutment surfaces 148 are provided at a position distant from the pair of first abutment surfaces 147 in the sheet-convey direction. Since the three pairs of first abutment surfaces 146, 147, 148 support the rear surface of the guide plate 104, the guide plate 104 is prevented from being moved outward of the first curved guide surface 100 thereof. Since the four engageable projections 142, 143 are engaged with the four engageable recesses 144, 145, respectively, in the state in which the rear surface of the guide plate 104 is supported by the six abutment surfaces 146, 147, 148, the guide plate 104 is firmly fixed to the guide base 101 in such a manner that the respective free end portions of the four engageable projections 142, 143 are elastically deformed and accordingly are biased by respective elastically restoring forces thereof against the guide base 101. Thus, the guide plate 104 is prevented from being moved inward of the first curved guide surface 100 thereof. Therefore, the guide plate 104 is accurately positioned relative to the guide base 101, while distortions of peripheral portions of the guide plate 104, if any, are corrected. The total number and/or locations of the first abutment surfaces 146, 147, 148 are not limited to the details of the present embodiment. However, the present embodiment is advantageous because the abutment surfaces 146, 147, 148 are provided at the locations corresponding to the end portions of the guide plate 104 where distortions and/or dimensional errors are likely to occur, and those abutment surfaces 146, 147, 148 are uniformly distributed over the area opposed to the rear surface of the guide plate 104.

The guide-plate holding portion 109 additionally has a second abutment surface 149 that projects widthwise inward from one of the widthwise opposite end portions of the holding portion 109, and abuts on a side surface of the guide plate 104. Since the second abutment surface 149 stops the side surface of the guide plate 104, the guide plate 104 is prevented from being moved in the widthwise direction of the guide base 101. Therefore, the guide plate 104 is effectively prevented from rattling relative to the guide-plate holding portion 109, and is accurately positioned relative to the guide base 101 with respect to the widthwise direction thereof. Thus, the respective first guide surfaces 100 of the four guide plates 103 through 106 are made substantially flush with each other and with the first guide surface 100 of the guide cover 102. Although the guide plates 103 through 106 are formed of the material (i.e., the synthetic resin) that is more advantageous with respect to frictional resistance than with respect to formability and appearance, the distortions of the guide plates 103 through 106 are effectively corrected and the adverse influences resulting from the dimensional errors thereof are effectively absorbed. In the present embodiment, the second abutment surface 149 is provided at the location corresponding to one of the widthwise opposite end portions of the guide-plate holding portion 109. However, another abutment surface 149 may be provided at a location corresponding to the other of the widthwise opposite end portions of the guide-plate holding portion 109, or two second abutment surfaces 149 may be provided at locations that are distant from each other in the sheet-convey direction.

Each of the guide plates 103, 105, 106 has a construction similar to that of the guide plate 104, and each of the guide-plate holding portions 108, 110, 111 has a construction similar to that of the guide-plate holding portion 109, although those members 103, 105, 106, 108, 110, 111 are not described in detail here. Each guide plate 103, 105, 106 is attached to the corresponding guide-plate holding portion 108, 110, 111 in the same manner as described, i.e., in such a manner that the respective engageable projections of the each guide plate 103, 105, 106 are engaged with the engageable recesses of the corresponding guide-plate holding portion 108, 110, 111 and, in this state, the respective rear and side surfaces of the each guide plate 108, 105, 106 are supported by the respective abutment surfaces of the corresponding guide-plate holding portion 108, 110, 111. Therefore, distortions of each guide plate 103, 105, 106, if any, are corrected, and adverse influences resulting from dimensional errors thereof, if any, are absorbed.

In this way, the respective individual first curved guide surfaces 100 of the four guide plates 103 through 106 are made substantially flush with each other to cooperate with the individual first curved guide surfaces 100 of the guide cover 102 to provide the composite first curved guide surface 100 over the substantially entire width of the outer guide 18. In fact, however, the composite first curved guide surface 100 is divided into the respective individual first curved guide surfaces 100 of the four guide plates 103 through 106 and the individual first curved guide surfaces 100 of the guide cover 102 in the widthwise direction of the outer guide 18. Therefore, distortions and/or dimensional errors of each one of the four guide plates 103 through 106 can be reduced. As described previously, each guide plate 103 through 106 is formed of the synthetic resin that is more advantageous with respect to frictional resistance than with respect to formability and appearance. Therefore, distortions and/or dimensional errors are more likely to occur to each guide plate 103 through 106. Distortions and/or dimensional errors of a molded or formed product, i.e., each guide plate 103 through 106 increase as dimensions thereof increase. If the four guide plates 103 through 106 are replaced with a single large guide plate, then distortions and/or flexural amounts of the large guide plate would be too large to correct, and accordingly it would be difficult for the large guide plate to have a single large first guide surface having a correct shape. In contrast, in the present embodiment, the plurality of guide plates 103 through 106 have the respective divided first guide surfaces 100 each of which has the small size. Therefore, the distortions of each guide plate 103 through 106 can be easily corrected and the dimensional errors thereof can be easily accommodated.

As is apparent from the foregoing description of the illustrated embodiment, the outer guide 18 that guides each recording sheet in the outer portion of the curved portion 17 of the sheet-convey path 23, includes the guide plates 103 through 106 that have the respective first curved guide surfaces 100 and that are formed of the synthetic resin having the smaller frictional resistance than that of the outer surfaces of the guide base 101. Therefore, the frictional resistance of each of the first curved guide surfaces 100 is smaller than that of the outer surfaces of the guide base 101, and accordingly each first guide surface 100 can smoothly guide each recording sheet. On the other hand, the guide base 101 that holds the guide plates 103 through 106 is formed of the material that is more advantageous with respect to formability and appearance than with respect to frictional resistance. Thus, the outer guide 18 can enjoy not only a good appearance but also a low frictional resistance.

In the illustrated embodiment, the sheet-convey path 23 includes the curved portion 17 including the U-turn portion. However, the principle of the present invention is applicable to such a sheet-convey path including a curved portion that does not include a U-turn portion.

In addition, in the illustrated embodiment, the guide cover 102 and the guide rollers 126 through 128 are provided in the widthwise middle portion of the outer guide plate 18. However, the guide cover 102 and the guide rollers 126 through 128 may be omitted. In the latter case, only the respective first curved guide surfaces 100 of the four guide plates 103 cooperate with each other to define the entire, composite first curved guide surface of the outer guide 18.

In the illustrated embodiment, the pair of shaft portions 130 of each guide roller 126, 127, 128 cooperate with each other to constitute the shaft integral with the roller body 129. However, the pair of shaft portions 130 may be replaced with a shaft member that is formed separately from a roller member corresponding to the roller body 129.

Hereinafter, three examples in accordance with the present invention, i.e., invention examples 1, 2, and 3 will be described. Invention examples 1, 2, and 3 correspond to three sorts of POM (polyacetal) each of which can be used as the material of the guide plates 103 through 106 and the cover plate 102. A comparative example corresponds to ABS (acrylonitrile butadiene styrene) that can be used as the material of the guide base 101. A friction coefficient, μ, of each of invention examples 1, 2, 3 and the comparative example with respect of each of ordinary paper and glossy paper is measured.

More specifically described, invention examples 1, 2, 3 are resin plates that are formed of three sorts of POM, respectively, available from Polyplastics Co., Ltd. under respective product names of DURACON M90-44, DURACON NW-02, and DURACON JW-03, and each have a size of 100 mm×100 nm. The comparative example is a resin plate that is formed of ABS available from UMG ABS, Ltd. under a product name of CYCOLAC AM, and has a size of 100 mm×100 mm. Friction coefficients are measured, in a tank having a temperature of 23° C. and a humidity of 50%, with a static friction coefficient measuring machine available from Shinto Scientific, Co., Ltd. under a product name of HEIDON-10. On a horizontal surface of each of the four resin plates, a sheet of ordinary paper available from Fuji Xerox Co., Ltd. under a product name of XEROX 4200, or a sheet of glossy paper sold by Brother Kogyo K.K. under a product name of BP60GL is placed such that each sheet stands upright. From this state, an angle, θ, of inclination of each resin plate relative to a horizontal plane is increased from 0 degree, and an angle θ at which each sheet starts to slide downward is measured. From the thus measured angle θ, a friction coefficient μ is determined according to the following expression: $\mu = \tan\theta$. The thus obtained results are shown in the following TABLE.

TABLE

| | ORDINARY PAPER μ | GLOSSY PAPER μ |
|---|---|---|
| INVENTION EXAMPLE 1 | 0.175 | 0.359 |
| INVENTION EXAMPLE 2 | 0.178 | 0.306 |
| INVENTION EXAMPLE 3 | 0.174 | 0.374 |
| COMPARATIVE EXAMPLE | 0.528 | 0.603 |

As is apparent from TABLE, each of invention examples 1, 2, 3 has a significantly lower friction coefficient μ than that of the comparative example, with respect to each of the ordinary paper and the glossy paper. Thus, it has been confirmed that since the outer guide 18 employs the guide plates 103 through 106 and the guide cover 102 each of which is formed of POM, the outer guide 18 can more smoothly guide each recording sheet being conveyed in the sheet-convey path 23, than the conventional guide member that is formed of ABS, because the guide plates 103 through 106 and the guide cover 102 exhibit the lower friction coefficient μ with respect to both the ordinary sheet and the glossy paper.

It is to be understood that the present invention may be embodied with various changes, modifications, and improvements that may occur to a person skilled in the art without departing from the spirit and scope of the invention defined in the appended claims.

What is claimed is:

1. A conveying apparatus for conveying a flexible sheet in a sheet-convey direction along a sheet-convey path including a curved portion, the conveying apparatus comprising:

an outer guide which defines an outer portion of the curved portion of the sheet-convey path, wherein the outer guide comprises:

a plurality of separate curved plates formed separately from each other and arranged in a widthwise direction of the sheet-convey path, wherein each of the plurality of separate curved plates comprises a respective first curved guide surface configured to contact the flexible sheet and cooperatively guide the flexible sheet; and a guide base comprising a plurality of holding portions configured to hold the plurality of separate curved plates, respectively, wherein each of the holding portions has one of:

a plurality of engageable recesses separated from each other, and a plurality of engageable projections separated from each other, and said each of the plurality of separate curved plates has the other of:

the plurality of engageable recesses, and the plurality of engageable projections, wherein the plurality of engageable recesses, and the plurality of engageable projections are configured to engage with each other such that said each holding portion holds a corresponding one of the plurality of the separate curved plates, and wherein said each of the plurality of separate curved plates is formed of a synthetic resin assuring that the first curved guide surface thereof has a first frictional resistance lower than a second frictional resistance of a surface of the guide base.

2. The conveying apparatus according to claim 1, further comprising an inner guide which defines an inner portion of the curved portion of the sheet-convey path and which cooperates with the outer guide to define the curved portion.

3. The conveying apparatus according to claim 1, further comprising a moving device which moves the flexible sheet along the sheet-convey path.

4. The conveying apparatus according to claim 1, wherein the respective first curved guide surfaces of the separate curved plates cooperate with each other to define a substantially entire width of the outer portion of the curved portion of the sheet-convey path, and thereby guide the flexible sheet with respect to an entire width thereof.

5. The conveying apparatus according to claim 1, wherein the plurality of separate curved plates comprise:

a middle plate which is provided in a widthwise middle portion of the outer portion of the curved portion of the sheet-convey path; and at least two side plates which are provided on either side of the middle plate, respectively, in the widthwise direction of the sheet-convey path, wherein the respective first curved guide surfaces of the middle plate and said at least two side plates are configured to contact the flexible sheet and cooperatively guide the flexible sheet.

6. The conveying apparatus according to claim 5, wherein the plurality of separate curved plates comprise at least two groups of said side plates which are provided on either side of the middle plate, respectively, in the widthwise direction of the sheet-convey path, and each group of said side plates comprise at least two said side plates which are arranged in the widthwise direction of the sheet-convey path.

7. The conveying apparatus according to claim 5, wherein the outer guide further includes at least one guide roller which includes a roller body and a shaft, and which is supported by the middle plate such that a portion of the roller body projects inward from the first curved guide surface of the middle plate and the roller body is rotatable about an axis of the shaft.

8. The conveying apparatus according to claim 1, wherein the engageable recesses and the engageable projections are engaged with each other to attach said each separate curved plate to the guide base such that the first curved guide surface of said each separate curved plate is positioned relative to the guide base with respect to the widthwise direction of the sheet-convey path and a direction perpendicular to a tangential plane of the first curved guide surface.

9. The conveying apparatus according to claim 1, wherein said each holding portion of the guide base has at least one rear surface abutment surface which abuts on a rear surface of the corresponding separate curved plate that is opposite to the first curved guide surface thereof, so as to cause the engageable projections and the engageable recesses to be firmly engaged with each other and thereby position the first curved guide surface of the corresponding separate curved plate relative to the guide base with respect to an outward direction of the curved portion that is perpendicular to a tangential plane of the first curved guide surface.

10. The conveying apparatus according to claim 1, wherein said each holding portion of the guide base has at least one side-surface abutment surface which extends in the sheet-convey direction and abuts on at least one side surface of the corresponding separate curved plate that extends in the sheet-convey direction, so as to cause the engageable projections and the engageable recesses to be firmly engaged with each other and thereby position the first curved guide surface of the corresponding separate curved plate relative to the guide base with respect to the widthwise direction of the sheet-convey path that is perpendicular to the sheet-convey direction.

11. The conveying apparatus according to claim 8, wherein the engageable recesses and the engageable projections are engaged with each other to attach said each separate curved plate to the guide base in a state in which said each separate curved plate having the first curved guide surfaces is elastically deformed and, owing to an elastically restoring force of said each separate curved plate, the first curved guide surface of said each separate curved plate is positioned relative to the guide base with respect to the direction perpendicular to the tangential plane of the first curved guide surface.

12. The conveying apparatus according to claim 1, further comprising a pair of conveying rollers which are provided on a downstream side of the outer guide with respect to the sheet-convey path, and which cooperate with each other to provide a nipping portion which is configured to nip the flexible sheet and thereby convey the flexible sheet, wherein the guide base comprises at least one second guide surface disposed downstream from the first curved guide surfaces in the sheet-convey direction, and wherein the at least one second guide surface has the second frictional resistance and is configured to guide the flexible sheet from the first curved guide surfaces to the nipping portion of the conveying rollers.

13. The conveying apparatus according to claim 12, wherein said each separate curved plate has at least one guide fin which projects downstream from a downstream-side end thereof with respect to the sheet-convey path, and which extends to a position in a vicinity of an upstream-side end of said at least one second guide surface of the guide base.

14. The conveying apparatus according to claim 1, wherein said each separate curved plate has a plurality of guide ribs which extend along the sheet-convey path and have respective top surfaces that cooperate with each other to define the first curved guide surface of said each separate curved plate.

15. The conveying apparatus according to claim 1, wherein the sheet-convey path is provided between a sheet-supply portion and a sheet-discharge portion, and includes, as the curved portion thereof, a U-turn portion through which the flexible sheet is reversed.

16. The conveying apparatus according to claim 1, wherein the synthetic resin comprises one of a polyacetal and a fluororesin.

17. The conveying apparatus according to claim 1, wherein the guide base is formed of a material comprising one of acrylonitrile butadiene styrene and polystyrene.

18. An image forming apparatus, comprising:

the conveying apparatus according to claim 1; and an image forming portion which is provided on a downstream side of the outer guide of the conveying apparatus in the sheet-convey path and which forms an image on the flexible sheet conveyed from the curved portion of the sheet-convey path by the conveying apparatus.

19. The conveying apparatus according to claim 1, wherein the plurality of engageable recesses comprise at least four engageable recesses comprising a first, a second, a third and a fourth engageable recess that are arranged such that the first and second engageable recesses are separated from the third and fourth engageable recesses in the sheet-convey direction, respectively, the first and second engageable recesses are separated from each other in the widthwise direction, and the third and fourth engageable recesses are separated from each other in the widthwise direction; and wherein the plurality of engageable projections comprise at least four engageable projections comprising a first, a second, a third and a fourth engageable projection that are arranged such that the first and second engageable projections are separated from the third and fourth engageable projections in the sheet-convey direction, respectively, the first and second engageable projections are separated from each other in the widthwise direction, and the third and fourth engageable projections are separated from each other in the widthwise direction, and wherein said at least four engageable projections and said at least four engageable recesses are configured to engage with each other such that said each holding portion holds the corresponding separate curved plate.

20. The conveying apparatus according to claim 1, wherein said each holding portion of the guide base holds the corresponding separate curved plate such that the first curved guide surface of the corresponding separate curved plate is immovable in the sheet-convey direction.

* * * * *